US006987496B2

(12) United States Patent
Koyama et al.

(10) Patent No.: US 6,987,496 B2
(45) Date of Patent: Jan. 17, 2006

(54) ELECTRONIC DEVICE AND METHOD OF DRIVING THE SAME

(75) Inventors: Jun Koyama, Kanagawa (JP); Shunpei Yamazaki, Tokyo (JP)

(73) Assignee: Semiconductor Energy Laboratory Co., Ltd., Atsugi (JP)

( * ) Notice: Subject to any disclaimer, the term of this patent is extended or adjusted under 35 U.S.C. 154(b) by 533 days.

(21) Appl. No.: 09/931,061

(22) Filed: Aug. 17, 2001

(65) Prior Publication Data

US 2002/0024054 A1 Feb. 28, 2002

(30) Foreign Application Priority Data

Aug. 18, 2000 (JP) ..... 2000-249087

(51) Int. Cl.
*G09G 3/30* (2006.01)

(52) U.S. Cl. ..... 345/76; 345/90; 345/204

(58) Field of Classification Search ..... 345/76–100, 345/204, 205
See application file for complete search history.

(56) References Cited

U.S. PATENT DOCUMENTS

| | | | |
|---|---|---|---|
| 4,432,610 | A | 2/1984 | Kobayashi et al. |
| 4,752,118 | A | 6/1988 | Johnson |
| 4,773,738 | A | 9/1988 | Hayakawa et al. |
| 4,996,523 | A | 2/1991 | Bell et al. |
| 5,091,722 | A | 2/1992 | Kitajima et al. |
| 5,125,045 | A | 6/1992 | Murakami et al. |
| 5,200,846 | A | 4/1993 | Hiroki et al. |
| 5,225,823 | A | 7/1993 | Kanaly |
| 5,247,190 | A | 9/1993 | Friend et al. |
| 5,339,090 | A | 8/1994 | Crossland et al. |
| 5,349,366 | A | 9/1994 | Yamazaki et al. |
| 5,424,752 | A | 6/1995 | Yamazaki et al. |
| 5,471,225 | A | 11/1995 | Parks |
| 5,479,283 | A | 12/1995 | Kaneko et al. |
| 5,600,169 | A | 2/1997 | Burgener et al. |
| 5,608,549 | A | 3/1997 | Usami |
| 5,642,129 | A | 6/1997 | Zavracky et al. |
| 5,673,422 | A | 9/1997 | Kawai et al. |

(Continued)

FOREIGN PATENT DOCUMENTS

CN 1337669 A 2/2002

(Continued)

OTHER PUBLICATIONS

Office Action (U.S. Appl. No. 09/919,832), Sep. 8, 2004, 11 pages.

(Continued)

*Primary Examiner*—Regina Liang
(74) *Attorney, Agent, or Firm*—Fish & Richardson P.C.

(57) ABSTRACT

In an electro-optical device for performing image display using an n-bit (where n is a natural number, n≧2) digital image signal, n×m (where m is a natural number) volatile memory circuits, and n×k (where k is a natural number) non-volatile memory circuits are contained in every one pixel. The electro-optical device has a function for storing m frame portions of the digital image signal in the volatile memory circuits, and k frame portions of the digital image signal in the non-volatile memory circuits. By performing display of a static image in accordance with repeatedly reading out, for each frame, the digital image signal stored once in the memory circuits and performing display, drive of a source signal line driver circuit can be stopped during that period. Further, a digital image signal stored in the non-volatile memory circuits is stored even after a power source is cut off, and therefore display is possible immediately when the power source is next turned on.

27 Claims, 23 Drawing Sheets

U.S. PATENT DOCUMENTS

| | | | | |
|---|---|---|---|---|
| 5,699,078 | A | 12/1997 | Yamazaki et al. | |
| 5,712,652 | A | 1/1998 | Sato et al. | 345/90 |
| 5,771,031 | A | 6/1998 | Kinoshita et al. | |
| 5,793,344 | A | 8/1998 | Koyama | |
| 5,798,746 | A | 8/1998 | Koyama | |
| 5,854,628 | A | 12/1998 | Nakagawa | |
| 5,907,313 | A | 5/1999 | Kubota et al. | |
| 5,945,866 | A | 8/1999 | Fonash et al. | |
| 5,945,972 | A | 8/1999 | Okumura et al. | |
| 5,959,598 | A | 9/1999 | McKnight | |
| 5,990,629 | A | 11/1999 | Yamada et al. | |
| 6,115,019 | A | 9/2000 | Perner | |
| 6,165,824 | A | 12/2000 | Takano et al. | |
| 6,246,386 | B1 | 6/2001 | Perner | |
| 6,259,846 | B1 | 7/2001 | Roach et al. | |
| 6,274,887 | B1 | 8/2001 | Yamazaki et al. | |
| 6,333,737 | B1 | 12/2001 | Nakajima | |
| 6,344,672 | B2 | 2/2002 | Huffman | |
| 6,344,843 | B1 | 2/2002 | Koyama et al. | |
| 6,356,028 | B1 | 3/2002 | Legagneux et al. | |
| 6,366,026 | B1 | 4/2002 | Saito et al. | |
| 6,380,876 | B1 | 4/2002 | Nagao | |
| 6,384,818 | B1 | 5/2002 | Yamazaki et al. | |
| 6,392,618 | B1 | 5/2002 | Kimura | |
| 6,441,829 | B1 | 8/2002 | Blalock et al. | |
| 6,445,368 | B1 | 9/2002 | Nakajima | |
| 6,456,267 | B1 | 9/2002 | Sato et al. | |
| 6,496,130 | B2 | 12/2002 | Nagao | |
| 6,535,192 | B1 | 3/2003 | Sung et al. | |
| 6,542,139 | B1 | 4/2003 | Kanno | |
| 6,545,654 | B2 | 4/2003 | Jacobsen et al. | |
| 6,545,708 | B1 | 4/2003 | Tamayama et al. | |
| 6,549,196 | B1 | 4/2003 | Taguchi et al. | |
| 6,556,176 | B1 | 4/2003 | Okuyama et al. | |
| 6,563,480 | B1 | 5/2003 | Nakamura | |
| 6,564,237 | B2 | 5/2003 | Ohashi et al. | |
| 6,630,916 | B1 | 10/2003 | Shinoda | |
| 6,636,194 | B2 | 10/2003 | Ishii | |
| 6,664,943 | B1 | 12/2003 | Nakajima et al. | |
| 6,670,938 | B1 | 12/2003 | Yoshida | |
| 6,683,596 | B2 | 1/2004 | Ozawa | |
| 6,731,264 | B2 | 5/2004 | Koyama et al. | |
| 6,738,054 | B1 | 5/2004 | Yamaguchi | |
| 6,747,623 | B2 | 6/2004 | Koyama | |
| 6,750,836 | B1 | 6/2004 | Katayama et al. | |
| 6,765,562 | B2 | 7/2004 | Yamazaki et al. | |
| 6,774,876 | B2 | 8/2004 | Inukai | |
| 2001/0005193 | A1 | 6/2001 | Yokoyama | |
| 2002/0000969 | A1 | 1/2002 | Ozawa | |
| 2002/0003521 | A1 | 1/2002 | Matsueda et al. | |
| 2002/0018029 | A1 | 2/2002 | Koyama | |
| 2002/0021274 | A1 | 2/2002 | Koyama et al. | |
| 2002/0021295 | A1 | 2/2002 | Koyama et al. | |
| 2002/0024054 | A1 | 2/2002 | Koyama et al. | |
| 2002/0024485 | A1 | 2/2002 | Koyama | |
| 2002/0036604 | A1 | 3/2002 | Yamazaki et al. | |
| 2002/0039087 | A1 | 4/2002 | Inukai | |
| 2002/0041266 | A1 | 4/2002 | Koyama et al. | |
| 2002/0057244 | A1 | 5/2002 | Koyama | |
| 2002/0089483 | A1 | 7/2002 | Yamazaki et al. | |
| 2002/0113763 | A1 | 8/2002 | Koyama | |
| 2002/0130828 | A1 | 9/2002 | Yamazaki et al. | |
| 2003/0067632 | A1 | 4/2003 | Ohta et al. | |
| 2003/0071772 | A1 | 4/2003 | Kimura | |
| 2003/0098875 | A1 | 5/2003 | Kurokawa et al. | |
| 2003/0103025 | A1 | 6/2003 | Kurokawa et al. | |
| 2004/0164322 | A1 | 8/2004 | Kondo et al. | |
| 2004/0183766 | A1 | 9/2004 | Koyama | |
| 2004/0222955 | A1 | 11/2004 | Koyama | |

FOREIGN PATENT DOCUMENTS

| | | |
|---|---|---|
| EP | 0 999 595 | 5/2000 |
| EP | 1 098 290 | 5/2001 |
| EP | 1 182 638 | 2/2002 |
| JP | 04-350627 | 12/1992 |
| JP | 06-102530 | 4/1994 |
| JP | 08-101669 | 4/1996 |
| JP | 08-194205 | 7/1996 |
| JP | 8-286170 | 11/1996 |
| JP | 08-286170 | 11/1996 |
| JP | 9-212140 | 8/1997 |
| JP | 10-092576 | 4/1998 |
| JP | 10-214060 | 8/1998 |
| JP | 10-232649 | 9/1998 |
| JP | 10-247735 | 9/1998 |
| JP | 10-253941 | 9/1998 |
| JP | 10-312173 | 11/1998 |
| JP | 11-64814 | 3/1999 |

OTHER PUBLICATIONS

Office Action (U.S. Appl. No. 09/923,433), Jul. 28, 2004, 9 pages.

Office Action (U.S. Appl. No. 09/930,956), Nov. 4, 2003, 17 pages.

Office Action (U.S. Appl. No. 09/930,956), Apr. 19, 2004, 17 pages.

Office Action (U.S. Appl. No. 09/930,956), Oct. 28, 2004, 17 pages.

Koyama et al., "A 4.0-in Poly Si TFT-LCD with Integrated 6-bit Digital Data Driver Using CGS Technology," 1999 International Workshop on Active-Matrix Liquid-Crystal Displays; Digest of Technical Papers; AM-LCD 99, Jul. 14-16, 1999; pp. 29-32.

H. Schenk et al., "Polymers for Light Emitting Diodes," EuroDisplay '99, 19th International Display Research Conference, Sep. 6-9, 1999, pp. 33-37.

Baldo et al., "Highly efficient phosphorescent emission from organic electroluminescent devices," Nature, vol. 395, Sep. 10, 1998, pp. 151-154.

Baldo et al., "Very high-efficiency green organic light-emitting devices based on electrophosphorescence," Applied Physics Letters, vol. 75, No. 1, Jul. 5, 1999, pp. 4-6.

Tsutsui et al., "High Quantum Efficiency in Organic Light-Emitting Devices with Iridium-Complex as a Triplet Emissive Center," Japan Journal of Applied Physics, vol. 38, part 2, No. 12B, Dec. 15, 1999, pp. L1502-L1504.

Tsutsui et al., "Electroluminescence in Organic Thin Films," Photochemical Processes in Organized Molecular Systems; Proceedings of the Memorial Conference for the Late Professor Shigeo Tazuke, Sep. 22, 1990, pp. 437-450.

T. Shimoda et al.; "Current Status and Future of Light-Emitting Polymer Display Driven by Poly-Si TFT"; *SID 99 Digest*; pp. 372-375; 1999.

T. Shimoda et al.; "High Resolution Light Emitting Polymer Display Device Driven by Low Temperature Polysilicon Thin Film Transistor with Integrated Driver"; *ASIA Display 98*; pp. 217-220; 1998.

C. W. Han et al.; "Green OLED with Low Temperature Poly Si TFT"; *EuroDisplay '99 Late-news papers*; pp. 27-30; Sep. 6-9, 1999.

Office Action (U.S. Appl. No. 09/916,306), Jan. 25, 2005, 15 pages.

Office Action (U.S. Appl. No. 09/930,956), May 2, 2005, 17 pages.

401 : SOURCE SIGNAL LINE
444 : STORAGE CAPACITOR ($C_S$)
445 : EL DRIVER TFT (NV)

804~806 : REFRESHING SIGNAL LINE

1 Second
1
2
3
4
.....
.....
59
60
1 FRAME PERIOD

Ta1
Ts1
Ta2
Ts2
Ta3
Ts3
1 SUBFRAME PERIOD
SUSTAIN PERIOD

ADDRESS PERIOD
1
2
3
4
479
480
ONE HORIZONTAL PERIOD 1
2
3
4
639
640
DOT DATA SAMPLING PERIOD
LINE DATA LATCH PERIOD

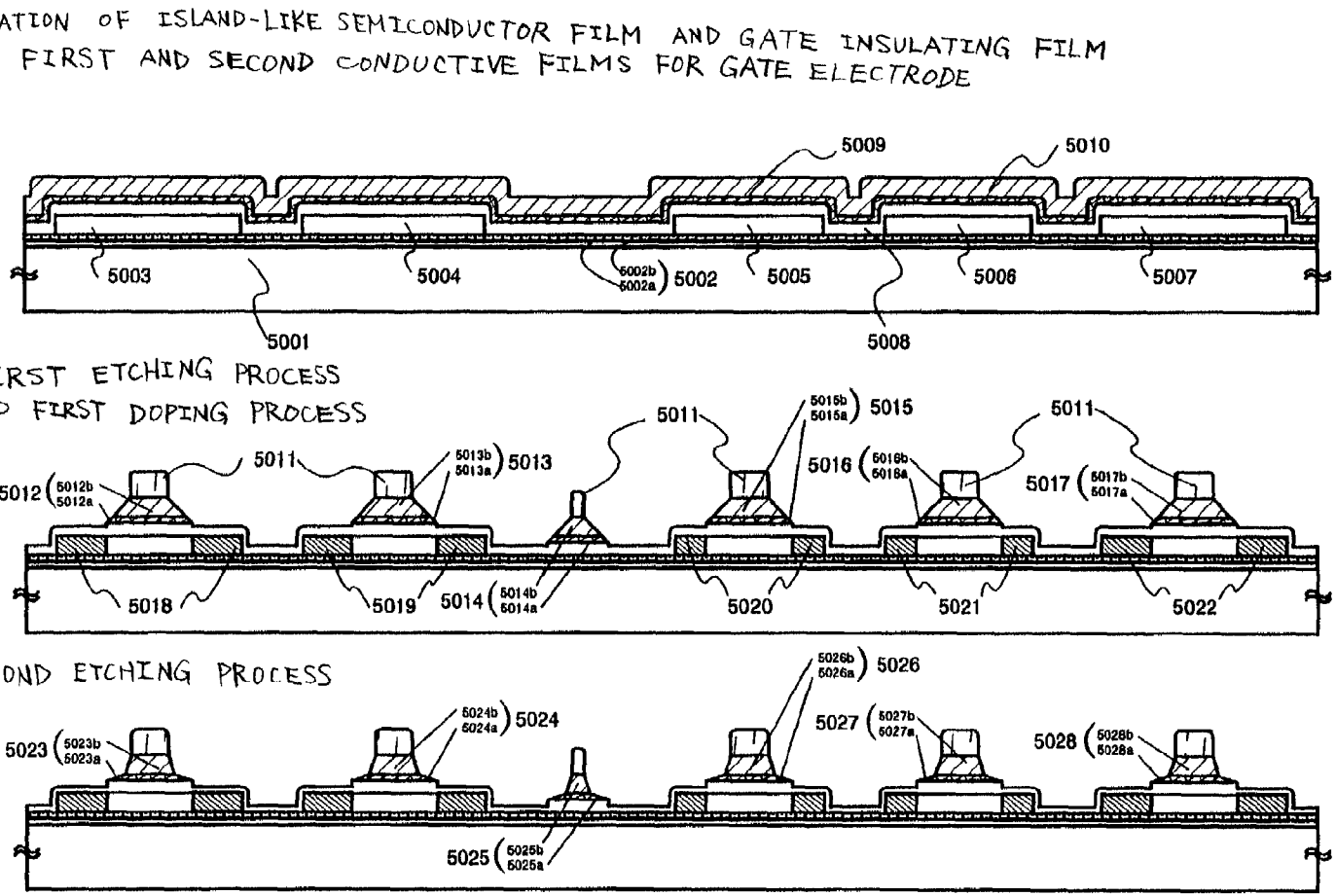
Fig.10A FORMATION OF ISLAND-LIKE SEMICONDUCTOR FILM AND GATE INSULATING FILM AND FIRST AND SECOND CONDUCTIVE FILMS FOR GATE ELECTRODE
Fig.10B FIRST ETCHING PROCESS AND FIRST DOPING PROCESS
Fig.10(C) SECOND ETCHING PROCESS

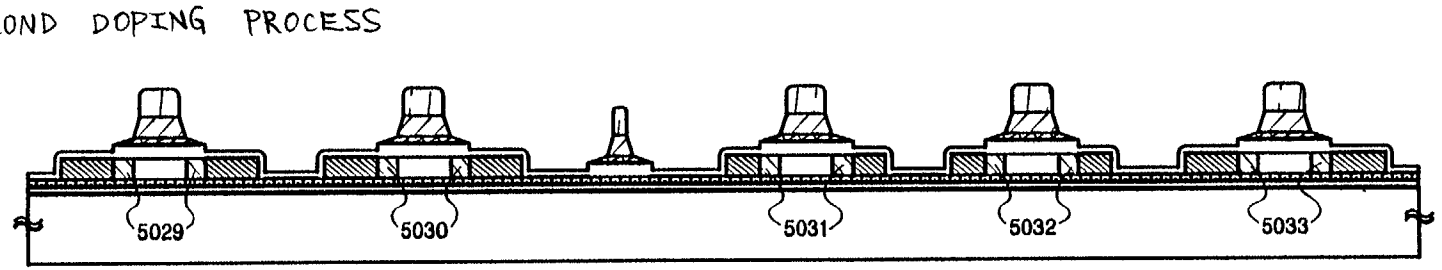
Fig.11A SECOND DOPING PROCESS
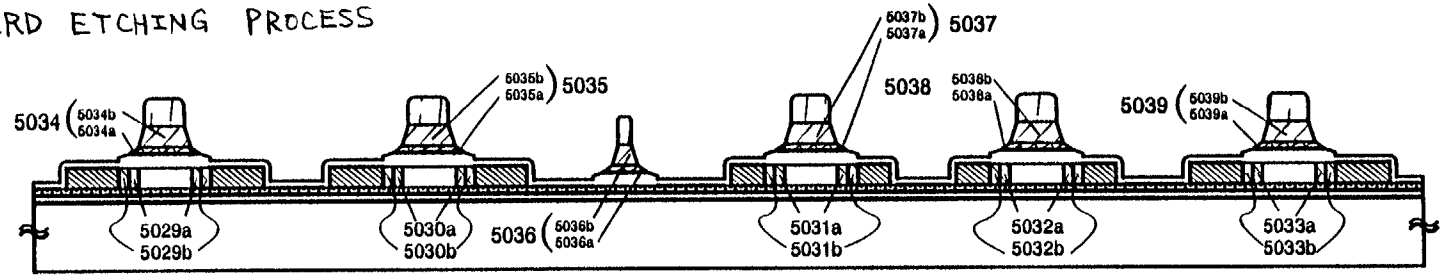
Fig.11B THIRD ETCHING PROCESS
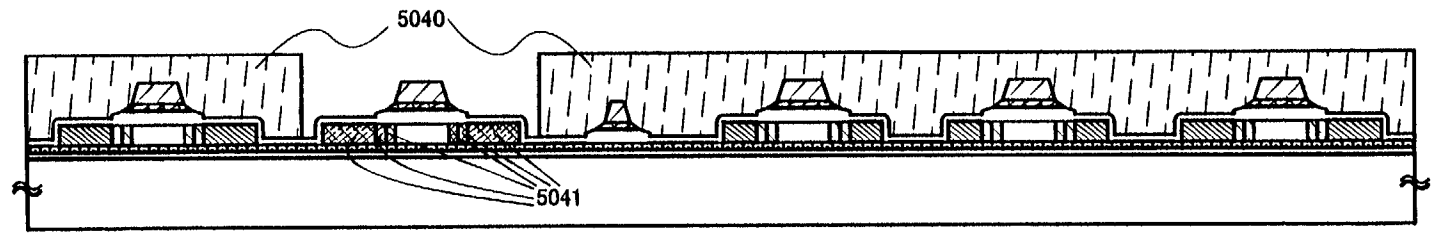
Fig.11C THIRD DOPING PROCESS

PRIOR ART

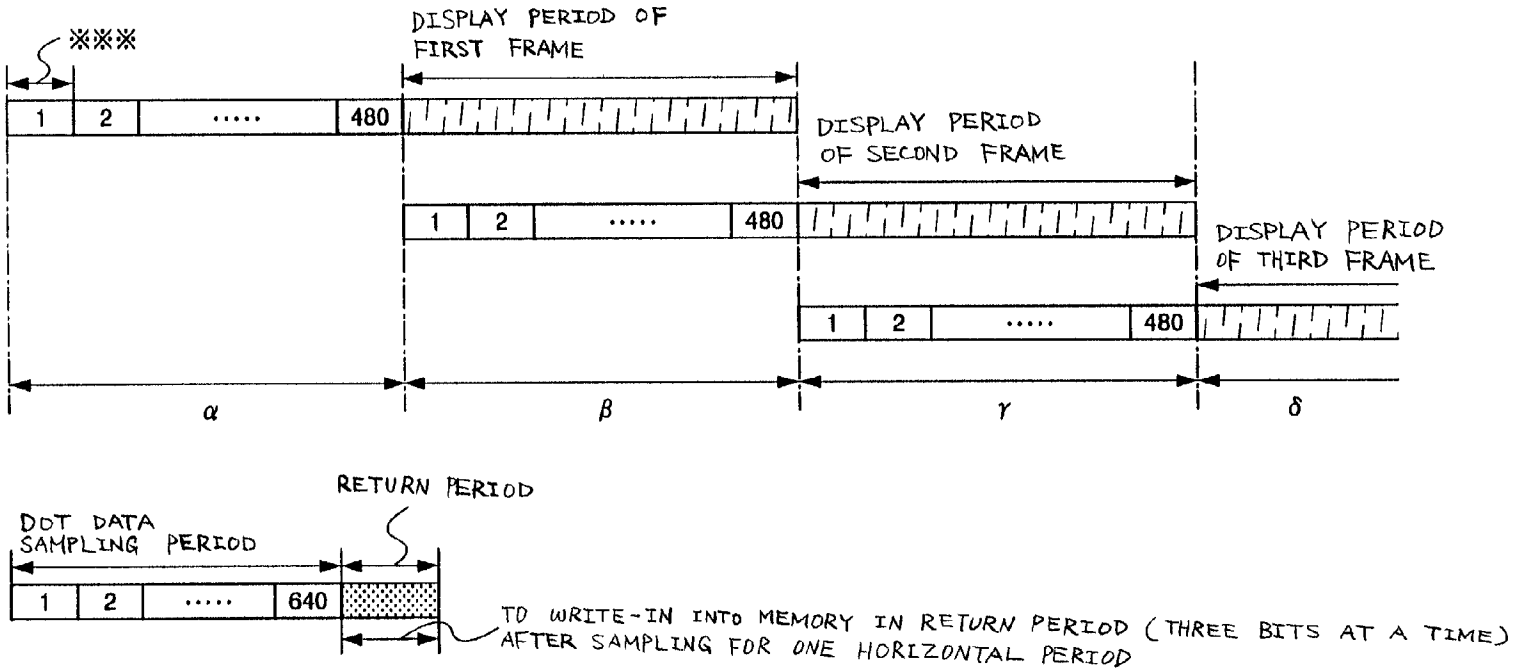
Fig.18A
Fig.18B
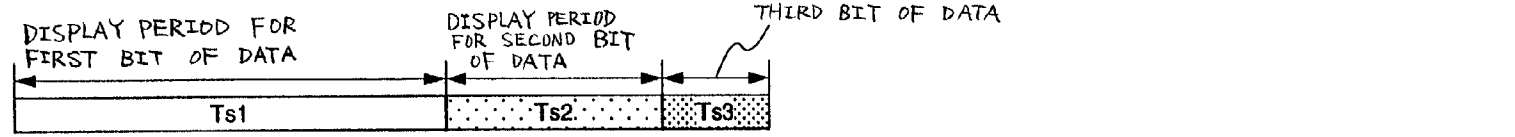
Fig.18C

PRIOR ART

BLOCK DIAGRAM OF PORTABLE INFORMATION TERMINAL

BLOCK DIAGRAM OF MOBILE TELEPHONE

BLOCK DIAGRAM OF TRANSMITTING AND RECEIVING CIRCUIT

ELECTRONIC DEVICE AND METHOD OF DRIVING THE SAME

BACKGROUND OF THE INVENTION

1. Field of the Invention

The present invention relates to an electronic device and a method of driving an electronic device. In particular, the present invention relates to an active matrix electronic device having thin film transistors formed on an insulator, and to an active matrix electronic device using the method of driving an electronic device. Among such devices, the present invention relates to an active matrix device using a digital image signal as an image source and using a self light emitting element such as an organic electro luminescence (EL) element (a light emitting diode or OLED (Organic Light Emission Diode)) in a pixel portion, and to an active matrix electronic device using the method of driving. The EL devices referred to in this specification include triplet-based light emission devices and/or singlet-based light emission devices, for example.

2. Description of the Related Art

The spread of electronic devices having a semiconductor thin film formed on an insulator such as a glass substrate, in particular active matrix electronic devices using thin film transistors (hereafter referred to as TFTs), has become remarkable in recent years. Active matrix electronic devices using TFTs have from several hundred thousand to several million TFTs arranged in a matrix shape, and display of an image is performed in accordance with controlling the electric charge of each pixel.

In addition, techniques relating to polysilicon TFTs in which pixel TFTs structuring pixels, and driver circuits using TFTs in the peripheral of a pixel portion, are formed at the same time have been developed recently. The miniaturization of the devices has contributed greatly to lowering their electric power consumption, and in accordance with their low power consumption and miniaturization, the electronic devices have become indispensable devices in portions such as display portions of mobile devices, an application which has exploded in recent years.

Further, research is enthusiastically being performed and all eyes are focused on electronic devices applying self-light emitting materials, such as organic EL materials, as a flat panel display substitute for LCDs (liquid crystal displays).

An example of a schematic diagram of a digital electronic device is shown in FIG. 13. A pixel portion 1307 is placed in the center. Source signal lines, gate signal lines, and in addition, an electric current supply line 1306 for supplying electric current to EL elements are arranged in the pixel portion 1307. A source signal line driver circuit 1301 is placed on the upper side of the pixel portion 1307 in order to control the source signal lines. The source signal line driver circuit 1301 has circuits such as shift register circuits 1303, first latch circuits 1304, and second latch circuits 1305. On the left and right of the pixel portion 1307 are arranged gate signal line driver circuits 1302 for controlling the gate signal lines. Note that although the gate signal line driver circuits 1302 are arranged on both left and right sides of the pixel portion 1307 in FIG. 13, they may also be placed on only one side. However, from a standpoint of driving efficiency and driving reliability, it is preferable to place them on both sides.

The source signal line driver circuit 1301 has a structure like that shown in FIG. 14, and has circuits such as shift register circuits (SR) 1401, first latch circuits (LAT1) 1402, and second latch circuits (LAT2) 1403. Note that, although not shown in FIG. 14, circuits such as buffer circuits and level shifter circuits may also be used when necessary.

The operation is explained simply using FIG. 13 and FIG. 14. First, clock signals (S-CLK and S-CLKb), and start pulses (S-SP) are input to the shift register circuit 1303 (denoted by SR in FIG. 14), and pulses are output one after another. Subsequently, the pulses are input to the first latch circuits 1304 (denoted by LAT1 in FIG. 14), and a digital image signal (digital data) input to the first latch circuits 1304 is stored. When the storage of each one bit portion of the digital image signal is completed during one horizontal period in the first latch circuit 1304, the digital image signal stored by the first latch circuit 1304 within a return period is transferred all at once to the second latch circuits 1305 (denoted by LAT2 in FIG. 14) in accordance with the input of a latch signal (latch pulse).

On the other hand, gate side clock signals (G-CLK) and gate side start pulses (G-SP) are input to shift registers (not shown in the FIGS.) in the gate signal line driver circuits 1302. The shift registers output pulses one after another based on the input signals, and these are output as gate signal line selection pulses through circuits such as buffers (not shown in the figures), and the gate signal lines are selected in order.

The data transferred to the second latch circuits 1305 of the source signal line driver circuit 1301 is then written into a column of pixels selected in accordance with the gate signal line selection pulse.

Driving operation of the pixel portion 1307 is explained next. A portion of the pixel portion 1307 is shown in FIGS. 19A and 19B. FIG. 19A shows a 3×3-pixel matrix, and a portion contained with a dotted line frame 1900 is one pixel. A blowup diagram of one pixel is shown in FIG. 19B. Reference numeral 1901 in FIG. 19B denotes a TFT which functions as a switching element when writing a signal into the pixel (hereafter referred to as a switching TFT). Either an n-channel polarity or a p-channel polarity may be used for the switching TFT 1901. Reference numeral 1902 denotes a TFT (hereafter referred to as an EL driver TFT), which functions as an element (electric current control element) in order to control electric current supplied to an EL element 1902. If a p-channel TFT is used for the EL driver TFT 1903, then it is arranged between an anode 1909 of the EL element 1903 and an electric current supply line 1907. As another, different structuring method, it is also possible to arrange the EL driver TFT 1902 between a cathode 1910 of the EL element 1903 and a cathode electrode 1908 if an n-channel TFT is used as the EL driver TFT 1902. However, a method in which the EL driver TFT 1902 is arranged between the anode 1909 of the EL element 1903 and the electric current supply line 1907 is general and often employed due to such factors as source grounding for TFT operation and manufacturing restrictions on the EL element 1903. Reference numeral 1904 denotes a storage capacitor in order to store a signal (voltage) input from the source signal line 1906. One terminal of the storage capacitor 1904 is connected to the electric current supply line 1907 in FIG. 19B, but a specialized wiring may also be used. A gate electrode of the switching TFT 1901 is connected to a gate signal line 1905, and a source region of the switching TFT 1901 is connected to the source signal line 1906.

Operation of active matrix electronic device circuits is explained next with reference to the same FIGS. 19A and 19B. First, a voltage is applied to the gate electrode of the switching TFT 1901 when the gate signal line 1905 is selected, and the switching TFT 1901 is placed in a conductive state. The signal (voltage) of the source signal line 1906 is stored in the storage capacitor 1904 by doing so. The voltage of the storage capacitor 1904 becomes a voltage VGS between a gate and a source of the EL driver TFT 1902, and therefore an electric current corresponding to the voltage of the storage capacitor 1904 flows in the EL driver TFT 1902 and the EL element 1903. The EL element 1903 turns on as a result.

The brightness of the EL element 1903, namely the amount of electric current flowing in the EL element 1903, can be controlled in accordance with $V_{GS}$ of the EL driver TFT 1902. $V_{GS}$ is the voltage of the storage capacitor 1904, and that is the signal (voltage) input to the source signal line 1906. In other words, the brightness of the EL element 1903 is controlled by controlling the signal (voltage) input to the source signal line 1906. Finally, the gate signal line 1905 is placed in an unselected state, the gate of the switching TFT 1901 is closed, and the switching TFT 1901 is placed in an unselected state. The electric charge, which has accumulated in the storage capacitor 1904, is maintained at this point. $V_{GS}$ of the EL driver TFT 1902 is therefore maintained as it is, and the amount of electric current corresponding to $V_{GS}$ continues to flow in the EL element 1903 via the EL driver TFT 1902.

Information regarding EL element drive is reported upon in papers such as the following: "Current Status and Future of Light-emitting Polymer Display Driven by Poly-Si TFT", SID99 Digest, p. 372; "High Resolution Light Emitting Polymer Display Driven by Low Temperature Polysilicon Thin Film Transistor with Integrated Driver", ASIA DISPLAY 98, p. 217; and "3.8 Green OLED with Low Temperature Poly-Si TFT", Euro Display 99 Late News, p. 27.

A method of gray scale display in an EL element is discussed next. An analog method of the gray scale display has a disadvantage in that it is weak with respect to dispersion in the electric current characteristics of the EL driver TFTs. Namely, if the electric current characteristics of the EL driver TFTs differ, then the value of electric current flowing in the EL driver TFTs and the EL elements changes even if the same gate voltages are applied. As a result, the EL element brightness, namely the gray scale, also changes.

A method referred to as a digital gray scale method has therefore been proposed in order to reduce the influence of dispersion in the characteristics of the EL driver TFTs. This method is a method for controlling the gray scale by two states, a state in which the absolute value of the gate voltage $|V_{GS}|$ of the EL driver TFT is below the turn on start voltage (in which almost no electric current flows), and a state in which the absolute value of the gate voltage $|V_{GS}|$ is greater than the brightness saturation voltage (in which an electric current close to the maximum flows). In this case, the value of the electric current becomes close to $I_{MAX}$ even if there are dispersion in the electric current characteristics of the EL driver TFTs, provided that the absolute value of the gate voltage $|V_{GS}|$ of the EL driver TFT is sufficiently larger than the brightness saturation voltage. The influence of EL driver TFT dispersions can therefore be made extremely small. The gray scales are thus controlled into an ON state (bright state due to maximum electric current flow) and an OFF state (dark state due to no electric current flow). This method is therefore referred to as a digital gray scale method.

However, only two gray scales can be displayed with the digital gray scale method. A plurality of techniques which can achieve multiple gray scales, in which another method is combined with the digital gray scale method, have been proposed.

A time gray scale method is one method that can be used to achieve multiple gray scales. The time gray scale method is a method in which the time during which the EL elements are turned on is controlled, and gray scales are output by the length of the turn on time. In other words, one frame period is divided into a plurality of subframe periods, and gray scales are realized by controlling the number and the length of the subframe periods during which turn on is performed.

Refer to FIGS. 9A to 9D. Drive timing for a circuit using a time gray scale method is shown simply in FIGS. 9A to 9D. An example of obtaining 3-bit gray scales by a time gray scale method with the frame frequency set to 60 Hz is shown.

As shown in FIG. 9A, one frame period is divided into a number of subframes corresponding to the number of gray scale bits. Three bits are used here, and therefore one frame period is divided into three subframes. One subframe period is further divided into an address period (Ta) and a sustain (turn on) period (Ts). (See FIG. 9B.) A sustain period during a subframe period, which is denoted by reference symbol $SF_1$, is referred to as $Ts_1$. Similarly, sustain periods for the cases of subframes $SF_2$ and $SF_3$ are referred to as $Ts_2$ and $Ts_3$, respectively. Address periods are periods during which one frame portion of an image signal is written into the pixels, and therefore the lengths of the address periods are equal in all of the subframe periods. (See FIG. 9C.) The sustain periods have lengths proportional to powers of 2, and the sustain periods here are such that $Ts_1:Ts_2:Ts_3=2^2:2^1:2^0=4:2:1$.

As a gray scale display method, the brightness is controlled by the length of the sum of all turn on periods within one frame period in accordance with controlling to set the EL elements either to a turned on state or a turned off state, in the sustain (turn on) periods from $Ts_1$ to $Ts_3$. In this example, $2^3=8$ turn on time lengths can be set by combining the sustain (turn on) periods, and therefore 8 gray scales can be displayed. Gray scales are thus expressed by utilizing the length of the turn on time.

In addition, the number of divisions within one frame period may also be increased for a case of increased gray scales. The proportional lengths of the sustain (turn on) periods for a case of dividing one frame period into n subframe periods becomes $Ts_1:Ts_2:\ldots:Ts_{(n-1)}:Ts_n=2^{(n-1)}:2^{(n-2)}:\ldots:2^1:2^0$, and it becomes possible to express $2^n$ gray scales.

In order to make dynamic display smooth in a general active matrix electronic device, renewal of the image display is performed approximately 60 time during one second, as shown in FIG. 9A. In other words, the digital image signal is supplied in every frame and it is necessary to perform write in to the pixels each time. For example, even if an image is static, the same signal must be supplied during every single frame, and therefore it is necessary for the driver circuit to operate continuously and to repeatedly process the same digital image signal.

There is also a method of once writing in a static digital image signal to an external memory circuit, and subsequently supplying the digital image signal from the external memory circuit during every single frame, but even in this case there is no change in the necessity for the external memory circuit and the driver circuit to operate continuously.

In particular, it is preferable that a mobile device has greatly reduced electric power consumption. In addition, even though a static picture mode occupies large portions with a mobile device, as stated above, circuits such as driver circuits continue to operate when displaying a static image, and this stops reductions in electric power consumption.

SUMMARY OF THE INVENTION

In consideration of problems such as those stated above, an object of the present invention is to reduce the electric power consumption of circuits such as external circuits and signal line driver circuits during display of a static image in accordance with using a novel circuit.

The following means are used in order to solve the above problems.

A plurality of memory circuits are arranged within a pixel, and a digital image signal is stored in each pixel. Information written into a pixel is subsequently the same for a static image, provided that write in is performed once, and therefore the static image can be continuously displayed by reading out the signal stored in the memory circuits without performing signal input during each frame. In other words, it becomes possible to stop the operation of circuits such as external circuits and source signal line driver circuits subsequent to performing signal processing operations of at least one frame portion when displaying a static image. It therefore becomes possible to greatly reduce the electric power consumption.

In addition, a portion of the memory circuits arranged within the pixel is a non-volatile memory circuit, and a digital image signal stored once in the non-volatile memory circuits can continue to be stored even after cutting off the electric power source of the display device. It consequently becomes possible to display the static image by reading out the digital image signal from the non-volatile memory circuits without again performing sampling of the digital image signal. Along with this, it becomes possible to greatly reduce the electric power consumption.

BRIEF DESCRIPTION OF THE DRAWINGS

In the accompanying drawings:

FIGS. 10A to 10C are diagrams showing an example of a method of manufacturing an electronic device having a pixel of the present invention;

FIGS. 11A to 11C are diagrams showing the example of the method of manufacturing an electronic device having a pixel of the present invention;

FIGS. 18A to 18C are diagrams showing timing charts in order to perform display using the circuit shown in FIG. 17;

DETAILED DESCRIPTION OF THE PREFERRED EMBODIMENTS

Embodiment Mode

Figure 2:
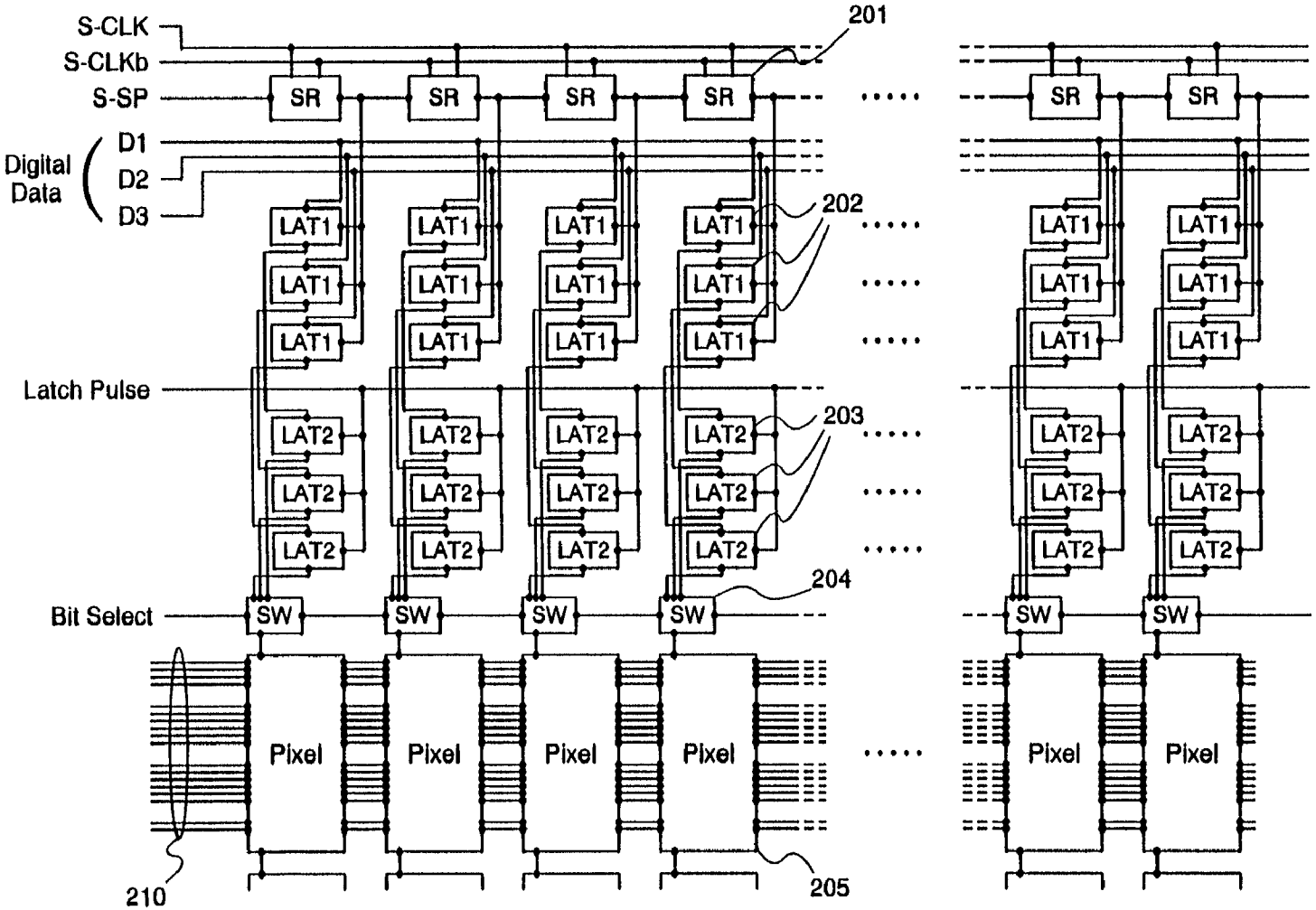
FIG. 2 is a diagram showing an example of a circuit structure of a source signal line driver circuit in order to perform display using a pixel of the present invention.

FIG. 2 shows a source signal line driver circuit and a structure of a portion of pixels in an electronic device using pixels having memory circuits. The circuit corresponds to a 3-bit digital gray scale signal, and has a shift register circuit 201, a first latch circuit 202, a second latch circuit 203, a bit signal selection switch 204, and a pixel 205. Reference numeral 210 denotes a signal line to which a signal supplied from a gate signal line driver circuit or from the outside is input, and an explanation of the signal line 210 is given later, along with that of the pixel.

Figure 1:
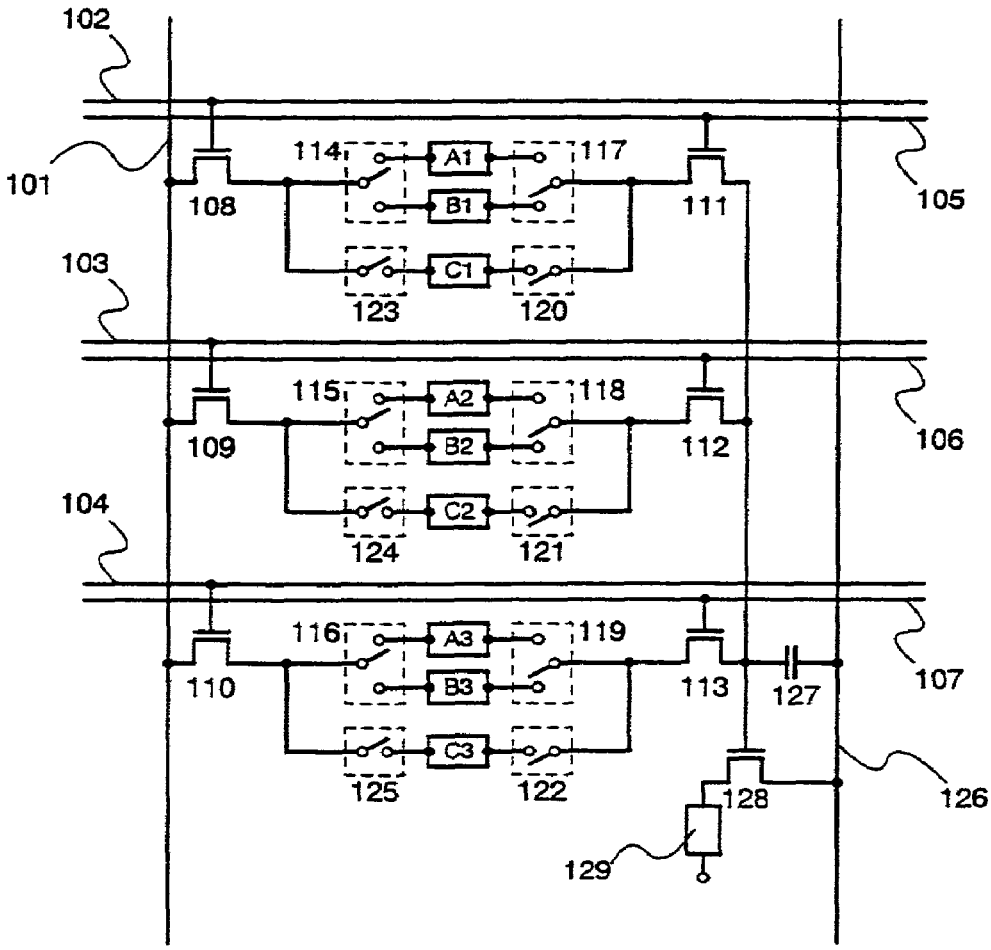
FIG. 1 is a circuit diagram of a pixel of the present invention having a plurality of volatile memory circuits and a plurality of non-volatile memory circuits in its interior.

FIG. 1 is a diagram showing in detail a circuit structure in the pixel 205 in FIG. 2. The pixel corresponds to 3-bit digital gray scales, and has an EL element (EL) 129, a storage capacitor (Cs) 127, volatile memory circuits (A1 to A3 and B1 to B3), non-volatile memory circuits (C1 to C3), and soon. Reference numeral 101 denotes a source signal line, reference numerals 102 to 104 denote gate signal lines used for write-in, reference numerals 105 to 107 denote gate signal lines used for read-out, and reference numerals 108 to 110 denote write-in TFTs. Reference numerals 111 to 113 denote read-out TFTs, reference numerals 114 to 116 and 120 to 122 denote write-in memory circuit selection portions, reference numerals 117 to 119 and 123 to 125 denote read-out memory circuit selection portions, reference numeral 126 denotes an electric current supply line, and reference numeral 128 denotes an EL driver TFT.

With the present invention, non-volatile memory circuits (denoted by the reference symbols C1 to C3 within FIG. 1) for storing at least one frame portion of an n-bit digital image signal are contained within the memory circuits of the pixel. In order to clearly segregate other memory circuits (denoted by the reference symbols A1 to A3, and B1 to B3 within FIG. 1) from the non-volatile memory circuits, the volatile memory circuits are referred to as such here. However, it is not necessary that the memory circuits structuring reference symbols A1 to A3 and B1 to B3 be volatile; they may also be non-volatile. However, it is necessary to perform write-in and read-out within one frame period, and it is necessary that the write-in time and read-out time be sufficiently short. Consequently, volatile memory circuits such as SRAMs and DRAMs are used in the embodiment mode of the present invention.

Figures 3A, 3B, 3C:
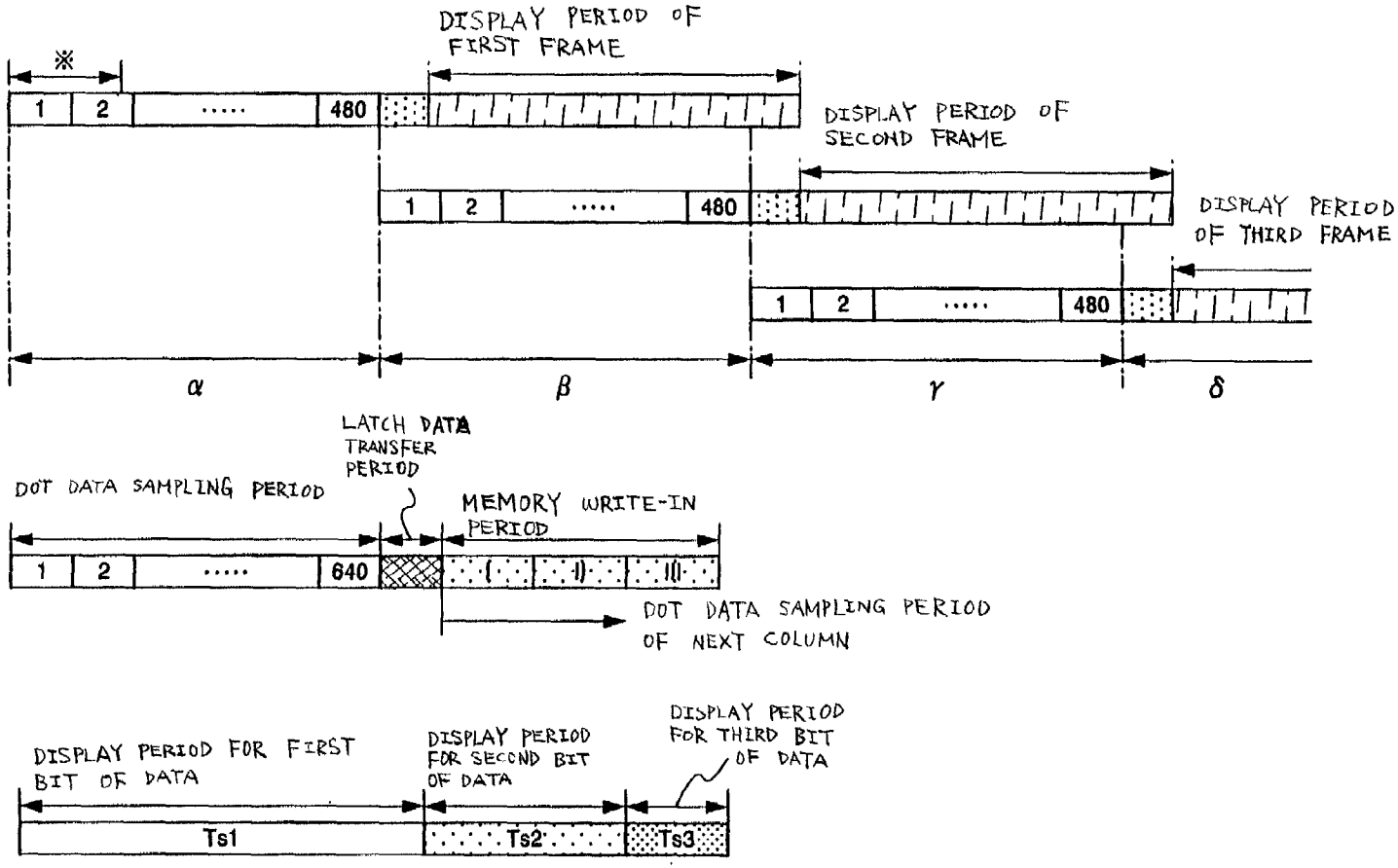
FIGS. 3A to 3C are diagrams showing timing charts for performing display using a pixel of the present invention.

FIGS. 3A to 3C are timing charts for the display device of the present invention shown in FIG. 1. The display device is one corresponding to VGA with 3-bit digital gray scales. A method of driving is explained using FIGS. 1 to 3. Note that the reference numerals of FIGS. 1 to 3 are used as is (Fig. Numbers are omitted).

Refer to FIG. 2 and to FIGS. 3A and 3B. Each frame period in FIG. 3A is denoted by reference symbols α, β, γ, and δ in FIG. 3A. Circuit drive in a section α is explained first.

Similar to the case of a conventional digital method driver circuit, clock signals (S-CLK and S-CLKb) and start pulses (S-SP) are input to the shift register circuit 201 and sequentially sampling pulses are output. The sampling pulses are then input to the first latch circuit (LAT1) 202, and digital image signals (digital data) input to the first latch circuit 202 are then stored. This period is denoted as a dot date sampling period in this specification. Single horizontal period portion of the dot data sampling period are each period denoted by reference numerals 1 to 480 in FIG. 3A. The digital image signal has three bits, and reference symbol D1 denotes the most significant bit (MSB), while reference symbol D3 denotes the least significant bit (LSB). When storage of one horizontal period portion of the digital image signal is completed in the first latch circuit 202, the digital image signal stored by the first latch circuit 202 is transferred all at once within the return period to the second latch circuit (LAT2) 203 in accordance with the input of a latch signal (latch pulse).

Subsequently, storage operation for the next horizontal period portion of the digital image signal is performed again in accordance with a sampling pulse output from the shift register circuit 201.

On the other hand, the digital image signal transferred to the second latch circuit 203 is written into the memory circuits arranged within the pixel. As shown in FIG. 3B, the dot sampling period of the next column is divided into three divisions, denoted by reference symbols I, II, and III, and the digital image signal stored in the second latch circuit is output to the source signal line. Each bit of the signal continues to be selectively output, in order, at this point by the bit signal selection switch 204 to the source signal line.

In the period I, a pulse is input to the write-in gate signal line 102, the TFT 108 is made conductive, the memory selection portion 114 selects the memory circuit A1, and the digital image signal is written into the memory circuit A1. Subsequently in the period II, a pulse is input to the write-in gate signal line 103, the TFT 109 is made conductive, the memory selection portion 115 selects the memory circuit A2, and the digital image signal is written into the memory circuit A2. Finally, in the period III, a pulse is input to the write-in gate signal line 104, the TFT 110 is made conductive, the memory selection portion 116 selects the memory circuit A3, and the digital image signal is written into the memory circuit A3.

Processing of one horizontal period portion of the digital image signal is thus completed. The period of FIG. 3B is the period shown by the symbol ·X· in FIG. 3A. By performing the above operations up through the final stage, one frame portion of the digital image signal is written into the memory circuits A1 to A3.

Three-bits of digital gray scales are expressed in the electronic device of the present invention in accordance with a time gray scale method. The time gray scale method differs from a normal method for performing control of brightness in accordance with a voltage applied to the pixel, and is a method in which only two types of voltage are applied to the pixel, resulting in two states, an ON state and an OFF state. Gray scales are obtained by utilizing the difference in the amount of turn on time. When performing n-bit gray scale expression in the time gray scale method, a display period is divided into n periods, and the length ratio of each period is set to powers of 2 so as to become $2^{n-1}:2^{n-2}: \ldots :2^0$. Expression of gray scales is performed by differences in the length of the turn on periods in accordance with whether or not the pixel is in the ON state in each period.

Further, display is also possible by performing gray scale display in accordance with divisions in which the display period is divided into lengths, which are other than powers of 2.

Operation in the section β is explained based on the above. Display of a first frame is performed when write in to the memory circuits is completed in the final state. FIG. 3C is a diagram for explaining a 3-bit time gray scale method. At this point the digital image signal is stored bit by bit in the memory circuits A1 to A3. Reference symbol Ts1 denotes a display period for the first bit of data, reference symbol Ts2 denotes a display period for the second bit of data, and reference numeral Ts3 denotes a display period for the third bit of data. The length of each display period becomes Ts1:Ts2:Ts3=4:2:1.

Eight levels in which the brightness varies from 0 to 7 are obtained here from the three bits. When display is not performed in any of the display periods Ts1 to Ts3, a brightness of 0 is obtained, while a brightness of 7 is obtained provided that display is performed using all of the periods. For example, if a brightness of 5 is desired, then display may be performed with the pixel placed in an ON state in the display periods Ts1 and Ts3.

This is explained specifically using the figures. In the display period Ts1, a pulse is input to the read-out gate signal line 105, the TFT 111 is made conductive, the memory circuit selection portion 117 selects the memory circuit A1, and the EL element is turned on in accordance with the digital image signal stored in the memory circuit A1. Subsequently, a pulse is input to the read-out gate signal line 106 in the display period Ts2, the TFT 112 is made conductive, the memory circuit selection portion 118 selects the memory circuit A2, and the EL element is turned on in accordance with the digital image signal stored in the memory circuit A2. Finally, a pulse is input to the read-out gate signal line 107 in the display period Ts3, the TFT 113 is made conductive, the memory circuit selection portion 119 selects the memory circuit A3, and the EL element is turned on in accordance with the digital image signal stored in the memory circuit A3.

Display of one frame period portion is thus performed. On the other hand, process of the digital image signal of the next frame period is performed at the same time in the driver circuit side. The procedure up through the transfer of the digital image signal to the second latch circuits is similar to the above stated procedure. The other memory circuits are then used in a period for writing into the memory circuits. However, when the volatile memory circuits formed within the pixel have one frame portion, the volatile memory circuits, which have been previously written into, are then written over.

In the period I, a pulse is input to the write-in gate signal line 102, the TFT 108 is made conductive, the memory circuit selection portion 114 selects the memory circuit B1, and the digital image signal is written into the memory circuit B1. Subsequently, a pulse is input to the write-in gate signal line 103 in the period II, the TFT 109 is made conductive, the memory circuit selection portion 115 selects the memory circuit B2, and the digital image signal is written into the memory circuit B2. Finally, a pulse is input to the write-in gate signal line 104 in the period III, the TFT 110 is made conductive, the memory circuit selection portion 116 selects the memory circuit B3, and the digital image signal is written into the memory circuit B3.

In the section γ, the display of the second frame is performed in accordance with the digital image signals stored in the memory circuits B1 to B3. At the same time, processing of the digital image signal of the next frame period begins. The digital image signal is again stored in the memory circuits A1 to A3, which have completed display of the first frame.

Display of the digital image signals stored in the memory circuits A1 to A3 is performed in the section δ, and processing of the digital image signal of the next frame period begins at the same time. The digital image signal is once again stored in the memory circuits B1 to B3, which have completed display of the second frame.

Write-in of the digital image signal to the non-volatile memory circuits C1 to C3 generally requires an extremely long time compared to write in to volatile memory circuits such as SRAMs, and therefore it is preferable to use means in which the digital image signal is stored once in the memory circuits A1 to A3, or B1 to B3, and then written into the non-volatile memory circuits C1 to C3 from there. In FIG. 1, the read-out TFTs 111 to 113 turn on and image display is performed after write in to the volatile memory circuits A1 to A3, or B1 to B3, is completed. The read-out TFTs 111 to 113 are OFF when performing write-in to the non-volatile memory circuits, the memory selection portions 117 to 119 select the non-volatile memory circuits C1 to C3, and write-in is performed. Display on a screen is not performed during this period, but the write in period is on the order of several ms to several 100s of ms and therefore almost no problem develops.

Further, for cases of performing image display by reading out the digital image signal stored in the non-volatile memory circuits C1 to C3 when the electric power source is turned on, the digital image signal may be written all at once into the volatile memory circuits A1 to A3, or B1 to B3, and may be read out from the volatile memory circuits A1 to A3 or B1 to B3.

Image display is performed continuously by repeating the above operations. For a case of displaying a static image here, the digital image signal stored in the memory circuits A1 to A3 in each frame period may be repeatedly read out after the digital image is stored once in the memory circuits A1 to A3 by the first operation. Driving of circuits such as external circuits and the source signal line driver circuit can therefore be stopped during a static image display period.

Further, the digital image signal can continue to be stored after the electric power supply of the display device is cutoff by writing the digital image signal into the non-volatile memory circuits C1 to C3 arranged in a pixel portion. It is therefore possible to display the static image without performing sampling of the digital image signal again after the electric power source is again turned on.

Figure 20:
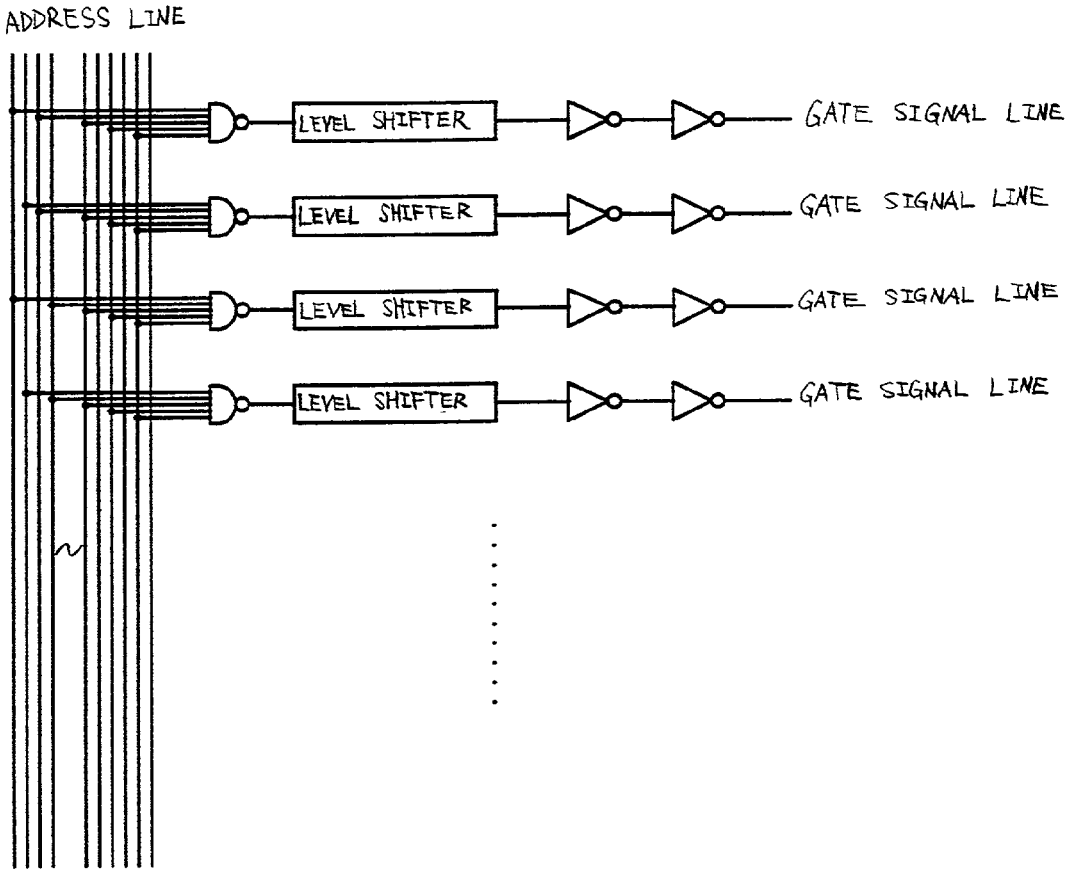
FIG. 20 is a diagram showing an example of a gate signal line driver circuit using a decoder.

In addition, it is possible to perform write-in of the digital image signal to the memory circuits, and read-out of the digital image signal from the memory circuits, in units of one gate signal line. Namely, display methods can be taken in which the source signal line driver circuit is driven only for a short period, or in which only a portion of the screen is re-written. It is preferable to use decoders as the gate signal line driver circuits in this case. The circuit disclosed in Japanese Patent Application Laid-open No. Hei. 8-101609 may be used for cases in which decoders are employed, and an example of a decoder is shown in FIG. 20. Further, it is possible to perform partial re-writing by using decoders in the source signal line driver circuit as well.

The volatile memory circuits A1 to A3, and B1 to B3, are contained within the pixel, and they function to store only two frame portions of the 3-bit digital image signal, but the present invention is not limited to these numbers. In other words, in order to store an m frame portion of an n-bit digital image signal, n×m volatile memory circuits may be contained within one pixel. Similarly, the non-volatile memory circuits C1 to C3 are contained within the pixel, and they function to store only one frame portion of the 3-bit digital image signal, but the present invention is not limited to these numbers. In other words, in order to store a k frame portion of an n-bit digital image signal after the electric power source is turned off, n×k non-volatile memory circuits may be contained within one pixel.

In accordance with the above method, and by performing storage of the digital image signal using memory circuits mounted within the pixel, continuous static display becomes possible, without driving circuits such as external circuits and the source signal line driver circuit, by repeating the digital image signal stored in the memory circuits by each frame period when performing display of a static image. This can contribute greatly to a reduction in the electric power consumption of the electronic device.

Further, it is not always necessary to form the source signal line driver circuit as integrated onto an insulator, due to problems in arranging circuits such as latch circuits which increase in number in response to the number of bits, and a portion of the source signal line driver circuit, or the entire circuit, may be formed as attached outside.

In addition, latch circuits corresponding to the number of bits are arranged in a source signal line driver circuit of an electronic device as described in this embodiment mode, and it is also possible to arrange only a one bit portion and then perform driving. In this case, the digital image signal may also be input to the latch circuits connected in series by outputting the digital image signal from most significant bit to the least significant bit.

Embodiments

Embodiments of the present invention are described below.

Embodiment 1

Structuring of the memory selection circuit portions in the circuit shown in the embodiment mode using specific transistors, and their operation are explained in embodiment 1.

Figure 4:
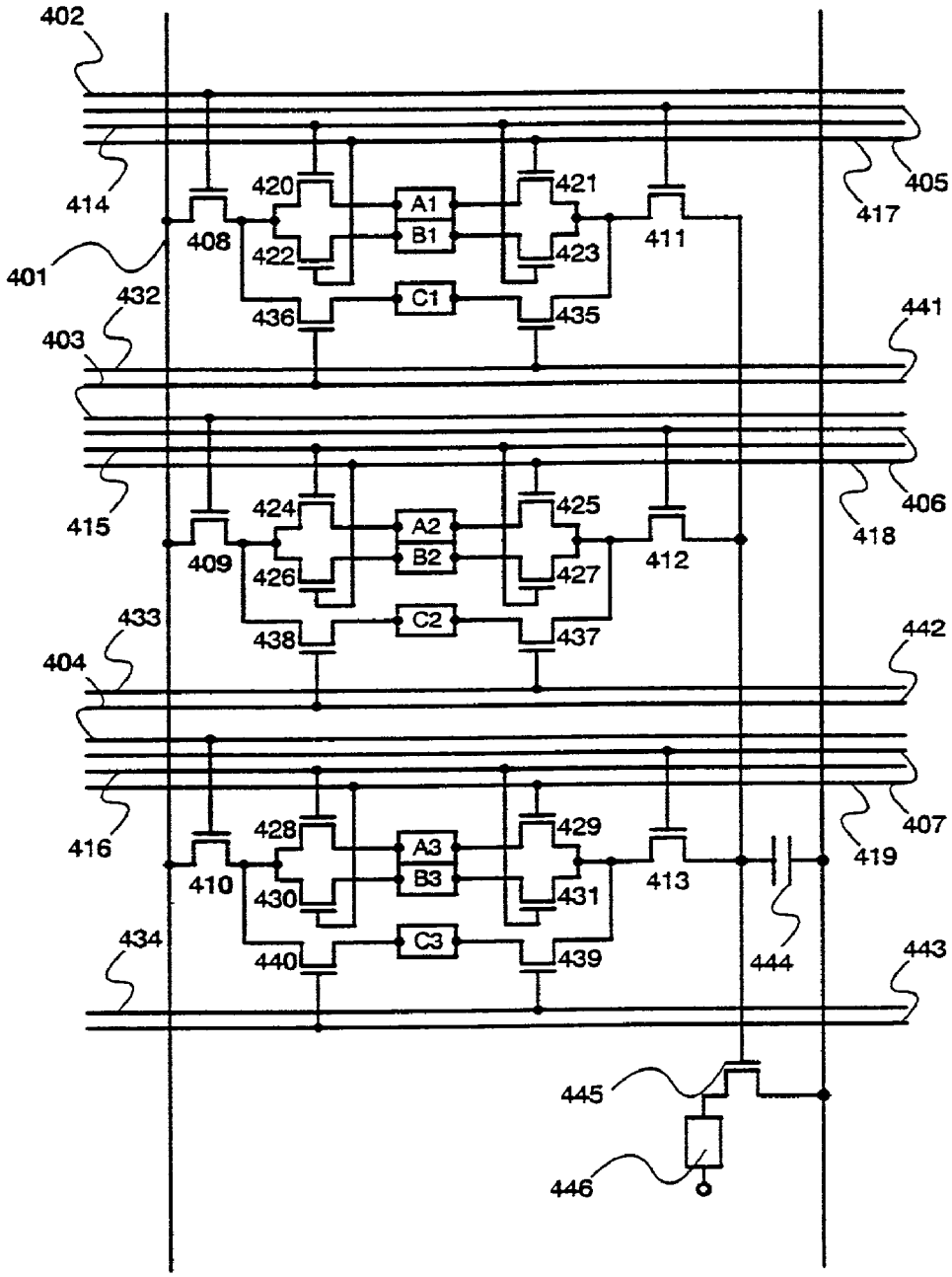
FIG. 4 is a detailed circuit diagram of a pixel of the present invention having a plurality of volatile memory circuits and a plurality of non-volatile memory circuits in its interior.

FIG. 4 is similar to the pixel shown in FIG. 1, and this is an example of structuring the periphery of the memory circuit selection portions with actual circuits. Within FIG. 4: write-in selection TFTs 420, 422, 424, 426, 428, and 430; and read-out selection TFTs 421, 423, 425, 427, 429, and 431 are formed in each of the volatile memory circuits A1 to A3, and B1 to B3. Control is performed using memory circuit selection signal lines 414 to 419. Write-in selection TFTs 435, 437, and 439, and read-out selection TFTs 436, 438, and 440 are formed in each of the non-volatile memory circuits C1 to C3, and control is performed using memory circuit selection signal lines 432 to 434, and 441 to 443. The pixel shown in embodiment 1 is one in which two frame portions of a 3-bit digital image signal are stored in the volatile memory circuits A1 to A3, and B1 to B3, and in addition, in which one frame portion of the 3-bit digital image signal is stored in the non-volatile memory circuits C1 to C3.

Drive of the circuit shown by FIG. 4 in embodiment 1 can be performed in accordance with the timing charts shown by FIGS. 3A to 3C of the embodiment mode. In addition to an actual method of driving the memory circuit selection portions, circuit drive is also explained using FIGS. 3A to 3C and FIG. 4. Note that the reference numbers of FIGS. 3A to 3C and FIG. 4 are used as is (figure numbers are omitted).

Refer to FIGS. 3A and 3B. The frame periods α, β, γ, and δ in FIG. 3A are explained. Circuit operation in the section α is explained first.

The driving method from a shift register circuit through a second latch circuit is similar to that shown in the embodiment mode, and therefore the embodiment mode is followed.

First, pulses are input to the memory circuit selection signal lines 414 to 416, the write-in selection TFTs 420, 424, and 428 are made conductive, a state in which write-in to the memory circuits A1 to A3 becomes possible. In the period I, a pulse is input to a write-in gate signal line 402, a TFT 408 is made conductive, and the digital image signal is written into the memory circuit A1. Subsequently in the period II, a pulse is input to a write-in gate signal line 403, a TFT 409 is made conductive, and the digital image signal is written into the memory circuit A2. Finally, in the period III, a pulse is input to a write-in gate signal line 404, a TFT 410 is made conductive, and the digital image signal is written into the memory circuit A3.

Processing of one horizontal period portion of the digital image signal is thus completed. The period of FIG. 3B is the period shown by the symbol ·X· in FIG. 3A. By performing the above operations up through the final stage, one frame portion of the digital image signal is written into the memory circuits A1 to A3.

Operation in the section β is explained next based on the above. Display of a first frame is performed when write in to the memory circuits is completed in the final state. FIG. 3C is a diagram for explaining a 3-bit time gray scale method. At this point the digital image signal is stored bit by bit in the memory circuits A1 to A3. The reference symbol Ts1 denotes the display period for the first bit of data, the reference symbol Ts2 denotes the display period for the second bit of data, and the reference numeral Ts3 denotes the display period for the third bit of data. The length of each display period becomes Ts1:Ts2:Ts3=4:2:1.

However, display is also possible even if gray scale display is performed by divisions in which the display period lengths are not powers of two.

Eight levels in which the brightness varies from 0 to 7 are obtained here from the three bits. When display is not performed in any of the display periods Ts1 to Ts3, a brightness of 0 is obtained, while a brightness of 7 is obtained provided that display is performed using all of the periods. For example, if a brightness of 5 is desired, then display may be performed with the pixel placed in an ON state in the display periods Ts1 and Ts3.

This is explained specifically using the figures. After completing write-in to the memory circuits, pulses are input to the memory circuit selection signal lines 414 to 416 when moving to the display period, and the write-in TFTs 420, 422, and 424 are placed in a non-conductive state. At the same time, pulses are input to the memory circuit selection signal lines 417 to 419, the read-out TFTs 421, 425, and 429 are made conductive, and read-out from the memory circuits A1 to A3 becomes possible. In the display period Ts1, a pulse is input to a read-out gate signal line 405, a TFT 411 is made conductive, and the EL element 446 is turned on in accordance with the digital image signal stored in the memory circuit A1. Subsequently, a pulse is input to a read-out gate signal line 406 in the display period Ts2, a TFT 412 is made conductive, and the EL element 446 is turned on in accordance with the digital image signal stored in the memory circuit A2. Finally, a pulse is input to a read-out gate signal line 407 in the display period Ts3, a TFT 413 is made conductive, and the EL element 446 is turned on in accordance with the digital image signal stored in the memory circuit A3.

Display of one frame period portion is thus performed. On the other hand, process of the digital image signal of the next frame period is performed at the same time in the driver circuit side. Up through the transfer of the digital image signal to the second latch circuits is similar to the above stated procedure. The memory circuits B1 to B3 are then used in a period for writing into the memory circuits.

Note that the write-in selection TFTs 420, 424, and 428 are conductive during the period during which the signal is written into the volatile memory circuits A1 to A3, thus being in a state in which it is possible to perform write-in to the volatile memory circuits. At the same time, the read-out selection TFTs 423, 427, and 431 are also conductive, thereby being in a state in which read-out from the volatile memory circuits B1 to B3 is possible. Conversely, the write-in selection TFTs 422, 426, and 430 are conductive during the period during which the signal is written into the volatile memory circuits B1 to B3, thus being in a state in which it is possible to perform write-in to the volatile memory circuits. At the same time, the read-out selection TFTs 421, 425, and 429 are also conductive, thereby being in a state in which read-out from the volatile memory circuits A1 to A3 is possible. In other words, write-in and read-out can be performed alternately in a certain frame period with the volatile memory circuits A1 to A3, and B1 to B3, in the pixel shown by embodiment 1.

In the period I, a pulse is input to the write-in gate signal line 402, the TFT 408 is made conductive, and the digital image signal is written into the memory circuit B1. Subsequently, a pulse is input to the write-in gate signal line 403 in the period II, the TFT 409 is made conductive, and the digital image signal is written into the memory circuit B2. Finally, a pulse is input to the write-in gate signal line 404 in the period III, the TFT 410 is made conductive, and the digital image signal is written into the memory circuit B3.

In the section γ, the display of the second frame is performed in accordance with the digital image signals stored in the memory circuits B1 to B3. At the same time, processing of the digital image signal of the next frame period begins. The digital image signal is again stored in the memory circuits A1 to A3, which have completed display of the first frame.

Display of the digital image signals stored in the memory circuits A1 to A3 is again performed in the section δ, and processing of the digital image signal of the next frame period begins at the same time. The digital image signal is once again stored in the memory circuits B1 to B3, which have completed display of the second frame.

Write-in and read-out of the digital image signal in the non-volatile memory circuits C1 to C3 is similar to that explained in the embodiment mode.

Display of an image is performed by repeating the above procedures. Note that the source signal line driver circuit is stopped after write-in of the digital image signal of a certain frame to the memory circuits is completed for a case of performing static image display, and display of the same signal written into the memory circuits is performed for each frame. The electric power consumption during display of a static image can be greatly reduced by using this type of method. In addition, by storing digital image signals using the non-volatile memory circuits, it is possible to store the static digital image signal even after the electric power source of the display device is cutoff, and display of the static image can be performed after the power source is again turned on.

Embodiment 2

An example in which a second latch circuit is omitted from a source signal line driver circuit by performing write-in to memory circuits of a pixel portion point by point is discussed in embodiment 2.

Figure 5:
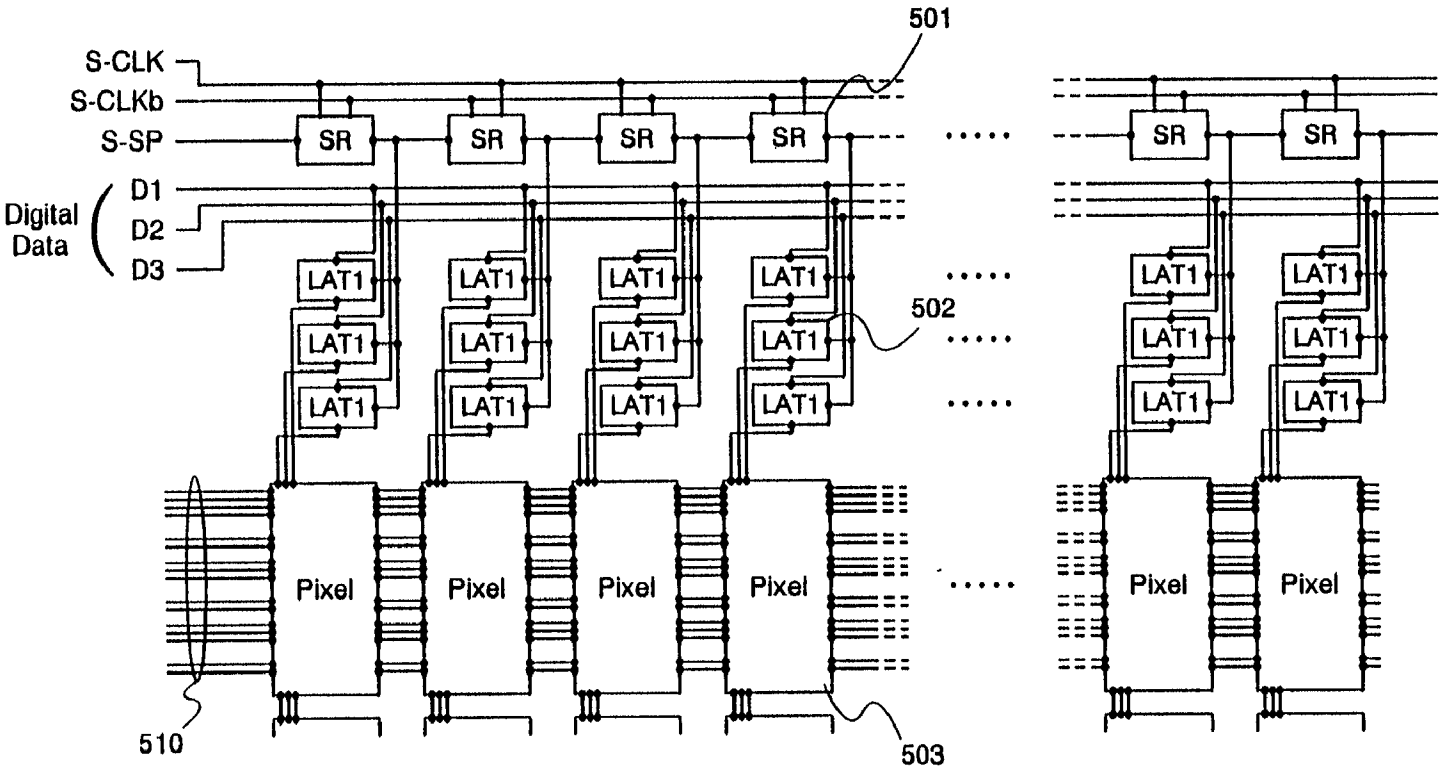
FIG. 5 is a diagram showing an example of a circuit structure of a source signal line driver circuit, which does not possess a second latch circuit.

FIG. 5 shows a structure of a source signal line driver circuit and a portion of a pixel in an electronic device using a pixel having memory circuits. This circuit corresponds to a 3-bit digital gray scale signal, and has a shift register circuit 501, a latch circuit 502, and a pixel 503. Reference numeral 510 denotes a signal line to which a signal supplied from a gate signal line driver circuit, or supplied directly from outside, is input, and its explanation, along with that of the pixel, is given later.

Figure 6:
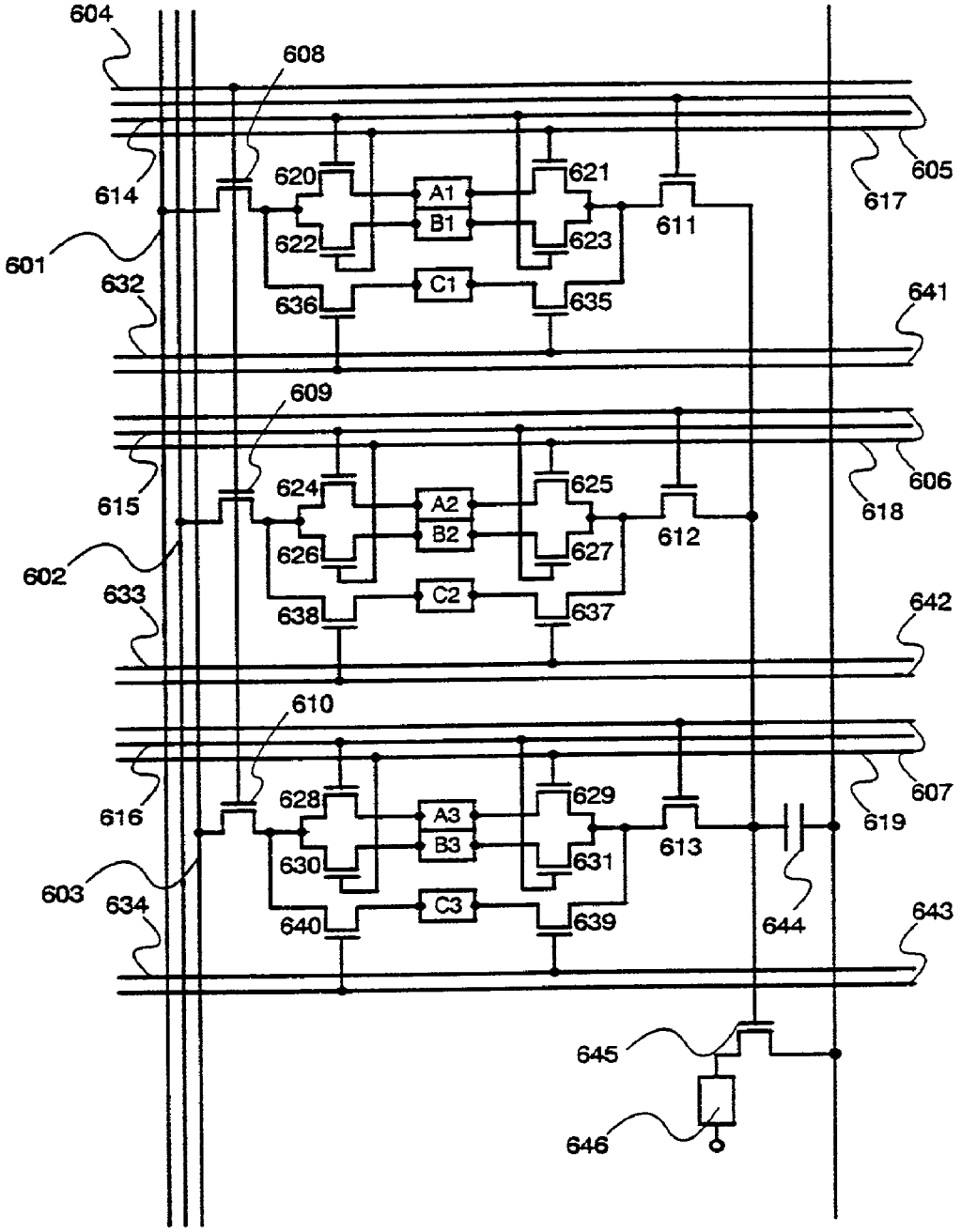
FIG. 6 is a detailed circuit diagram of a pixel applying the present invention and which is driven by the source signal line driver circuit of FIG. 5.

FIG. 6 is a detailed diagram of a circuit structure of the pixel 503 shown in FIG. 5. Similar to embodiment 1, this corresponds to 3-bit digital gray scales, and has an EL element 646, a storage capacitor 644, volatile memory circuits (A1 to A3, and B1 to B3), and non-volatile memory circuits (C1 to C3). Reference numeral 601 denotes a source signal line used for a first bit (MSB) of a signal, reference numeral 602 denotes a source signal line used for a second bit of the signal, reference numeral 603 denotes a source signal line used for a third bit (LSB) of the signal, and reference numeral 604 denotes a write-in gate signal line. Reference numerals 605 to 607 denote read-out gate signal lines, 608 to 610 denote write-in TFTs, and 611 to 613 denote read-out TFTs. A memory circuit selection portion is structured using write-in selection TFTs 620, 622, 624, 626, 628, and 630, and read-out selection TFTs 621, 623, 625, 627, 629, and 631, and so on. Reference numerals 632 to 634, and 641 to 643, denote memory circuit selection signal lines. For the non-volatile memory circuits C1 to C3, a memory selection portion is structured using write-in selection TFTs 636, 638, and 640, and by read-out selection TFTs 635, 637, and 639. The electric current supply line 635, the storage capacitor 638, the EL driver TFT 645, and the EL element 637 may be similar to those of embodiment 1.

Figure 7A:
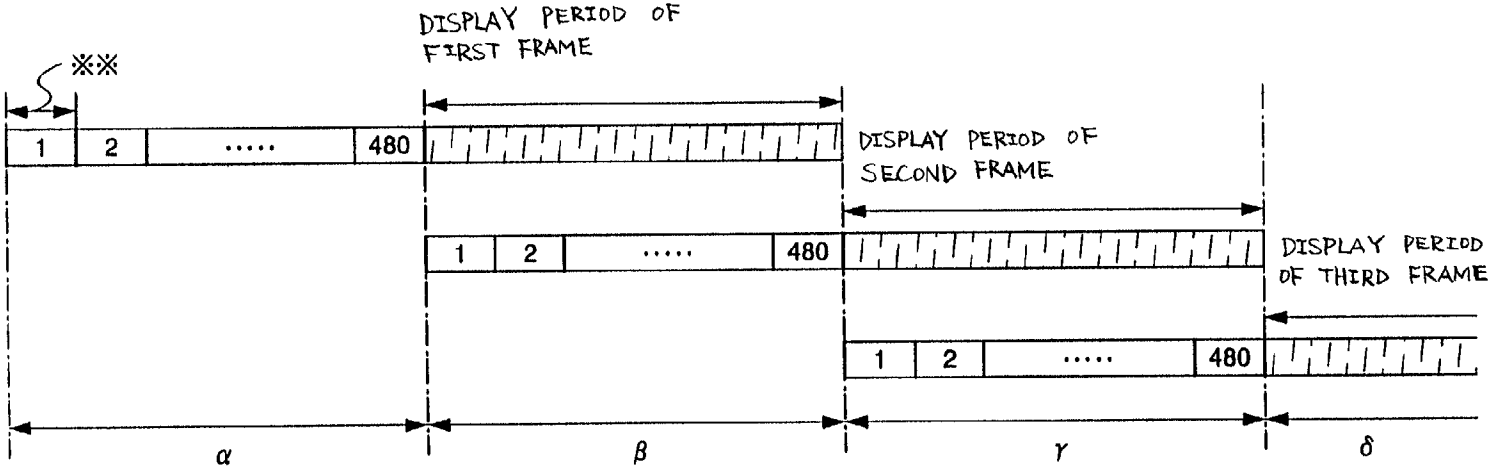
FIGS. 7A to 7C are diagrams showing timing charts for performing display using the circuits shown in FIG. 5 and in FIG. 6.
Figure 7B:
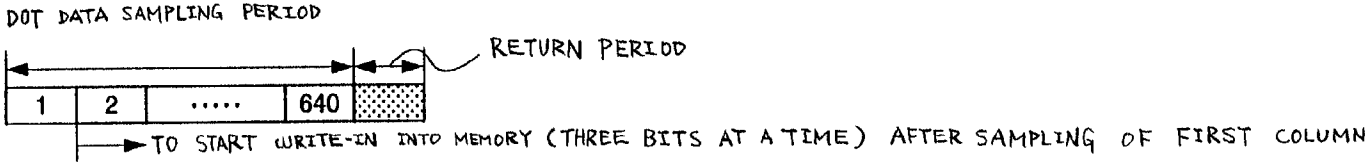

FIGS. 7A and 7B are timing charts relating to driving the circuits shown in embodiment 2. An explanation is made using FIG. 5, FIG. 6, and FIGS. 7A and 7B.

Operation from the shift register circuit 501 to the latch circuit (LAT1) 502 is performed similarly to that of the embodiment mode and embodiment 1. As shown in FIG. 7B, when the latch operation of a first stage is complete, write-in to the volatile memory circuits within the pixel begins immediately. A pulse is input to the write-in gate signal line 604, and the write-in TFTs 608 to 610 are made conductive. In addition, a pulse is input to the memory circuit selection signal line 626, and write-in selection TFTs 614, 618, and the write-in selection TFT 622 are made conductive. This becomes a state in which write-in to the volatile memory circuits A1 to A3 is possible. The digital image signal, which is stored bit by bit in the latch circuit 502, is written in, at the same time, via the three source signal lines 601 to 603.

When the digital image signal for a first stage, stored in the latch circuit, is written into the volatile memory circuits, storage of the digital image signal into the latch circuit is performed for the next stage in accordance with a sampling pulse. Write-in to the volatile memory circuits is thus performed in order.

The above is performed within one horizontal period (a period denoted by the reference symbol ·X·X· in FIG. 7A), is repeated for the number of gate signal lines which exist. When write-in of one frame portion of the digital image signal to the volatile memory circuits is complete in a section α, there is transfer to the first frame display period shown by a section β. Input of pulses to the write-in gate signal line 604 is stopped, and in addition, the memory circuit selection signal lines 614 to 616 are stopped, and the write-in selection TFTs 620, 624, and 628 become non-conductive. Pulses are input to memory circuit selection signal lines 617 to 619, the read-out selection TFTs 621, 625, and 629 are made conductive, and this becomes a state in which read-out from the volatile memory circuits A1 to A3 is possible.

Figure 7C:
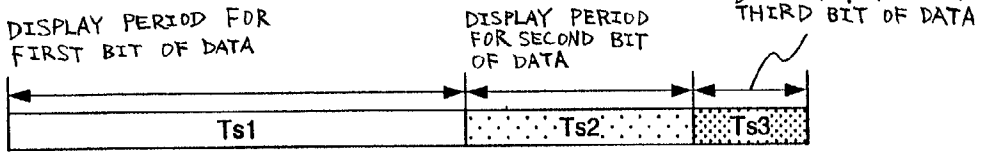

Subsequently, in accordance with the time gray scale method shown by embodiment 1, and as shown in FIG. 7C, a pulse is input to the read-out gate signal line 605 in the display period Ts1, the read-out TFT 611 becomes conductive, and display is performed by the digital image signal written into the volatile memory circuit A1. A pulse is input to the read-out gate signal line 606 in the display period Ts2, the read-out TFT 612 is made conductive, and display is performed by the digital image signal written into the volatile memory circuit A2. Similarly, a pulse is input to the read-out gate signal line 607 in the display period Ts3, the read-out TFT 613 is made conductive, and display is performed in accordance with the digital image signal written into the volatile memory circuit A3.

The first frame of the display period is complete by the above. In the section β, processing of the digital image signal in the next frame is similarly performed. The procedures are similar to those discussed above, up through storage of the digital image signal in the latch circuit 502. Subsequently, the volatile memory circuits B1 to B3 are used in a period for writing into the volatile memory circuits.

Note that the write in selection TFTs 620, 624, and 628 are made conductive in the period for writing signals into the volatile memory circuits A1 to A3, and this becomes a state in which write-in to the volatile memory circuits A1 to A3 is possible. Similarly, the read-out selection TFTs 623, 627, and 631 are also made conductive, and this becomes a state in which it is possible to read out from the volatile memory circuits B1 to B3. Conversely, the write in selection TFTs 622, 626, and 630 are made conductive in the period for writing signals into the volatile memory circuits B1 to B3, and this becomes a state in which write-in to the volatile memory circuits B1 to B3 is possible. At the same time, the read-out selection TFTs 621, 625, and 629 are also made conductive, and this becomes a state in which it is possible to read out from the volatile memory circuits A1 to A3. In other words, write-in and read out can be performed alternately for the volatile memory circuits A1 to A3, and B1 to B3, in a certain frame period in the pixel shown by embodiment 2.

Write-in operations and read-out operations with the memory circuits B1 to B3 are similar to the case of the volatile memory circuits A1 to A3. A section γ, begins when write-in to the volatile memory circuits B1 to B3 is complete, moving to a period for displaying a second frame. In addition, processing of the digital image signal of the next frame is performed in this section. Procedures are similar to those discussed above up through the storage of the digital image signal in the latch circuit 502. The volatile memory circuits A1 to A3 are again used in a period for write-in to the volatile memory circuits.

Display of the digital image signal stored in the volatile memory circuits A1 to A3 is performed in a section δ, and processing of the digital image signal of the next frame period begins at the same time. The digital image signal is again stored in the volatile memory circuits B1 to B3 when display of the second frame is complete.

Write-in operations for the digital image signal, and read-out operations, for the non-volatile memory circuits C1 to C3 are performed similar to those of the embodiment mode.

Display of an image is performed by repeating the above procedures. The source signal line driver circuit is stopped after write-in of the digital image signal of a certain frame to the memory circuits is complete for a case of performing static image display, and display of the signal written into the same memory circuits is performed for each frame. In addition, display is performed based on the digital image signal stored in the non-volatile memory circuits when a static image is displayed after turning off the power source once and then again connecting the power source. The electric power consumption can be greatly reduced during display of a static image in accordance with this type of method. In addition, the number of latch circuits can be reduced by one-half in comparison to the circuits shown in embodiment 1, and this can contribute to making the overall device smaller by conservation of space in the circuit arrangement.

Embodiment 3

An example of an electronic device using a method in which write-in to memory circuits within a pixel is performed by line-sequential drive is discussed in embodiment 3. The circuit structure of the electronic device in embodiment 3 corresponds to that shown in embodiment 2, in which the second latch circuit is omitted.

Figure 17:
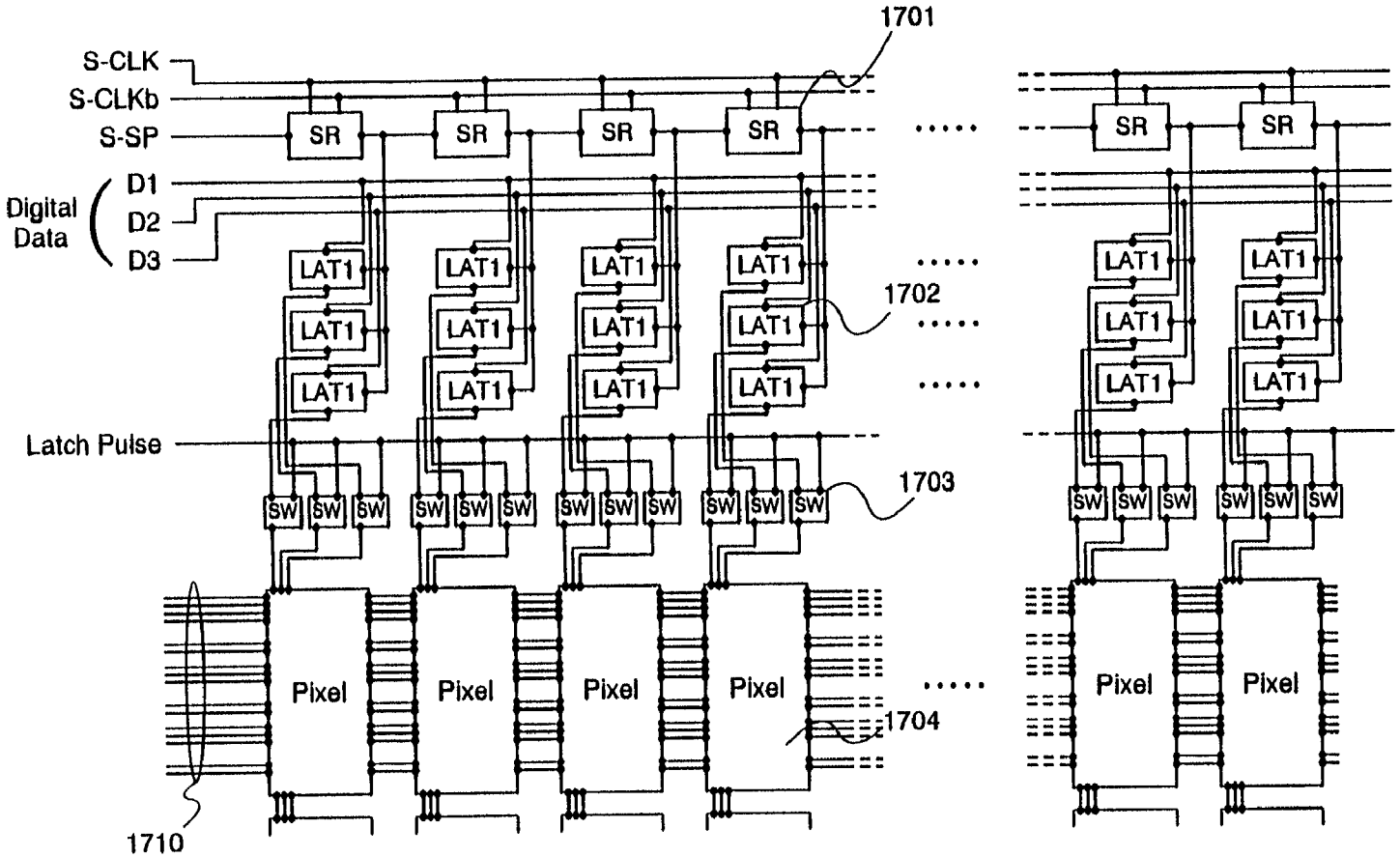
FIG. 17 is a diagram showing an example of a circuit structure of a source signal line driver circuit, which does not possess a second latch circuit.
Figure 19A:
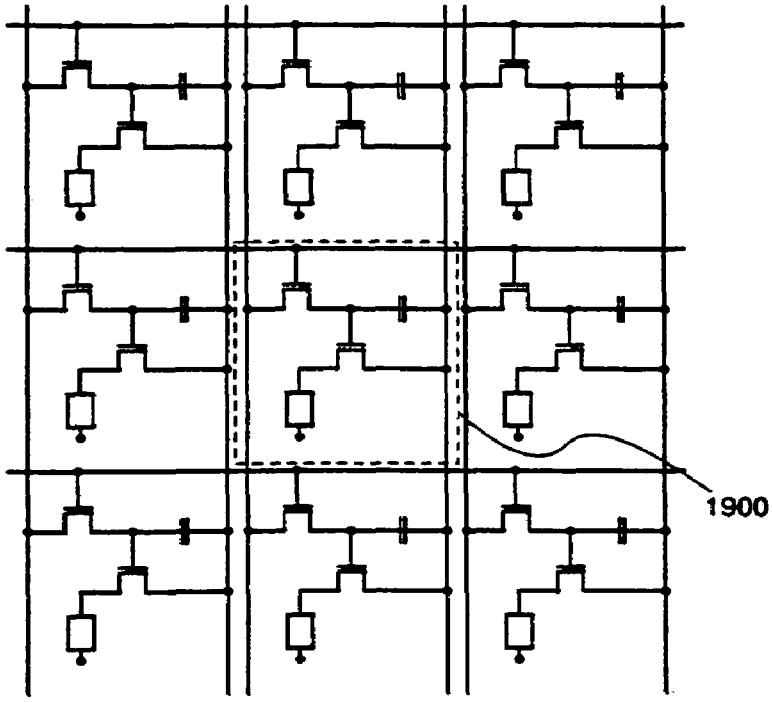
FIGS. 19A and 19B are blow up diagrams of a pixel portion of a conventional electronic device.
Figure 19B:
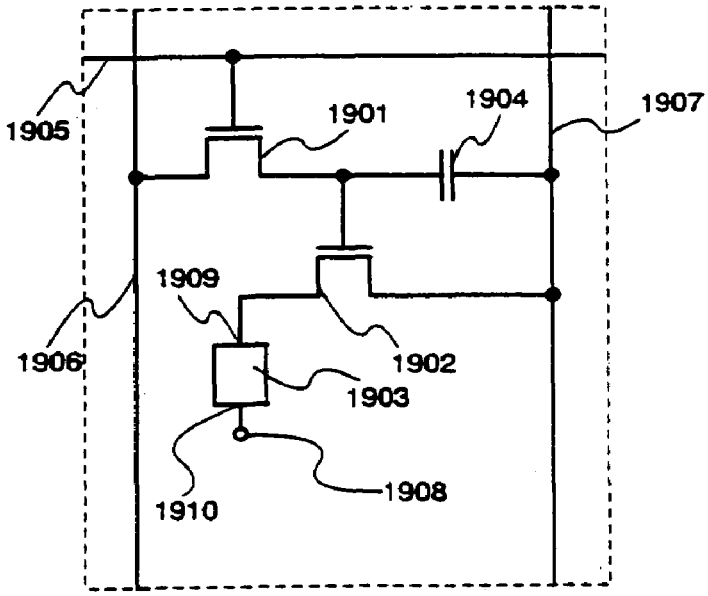
PRIOR ART Fig. 19B

FIG. 17 shows an example circuit structure of a source signal line driver circuit of the electronic device shown in embodiment 3. The circuit here corresponds to a 3-bit digital gray scale signal, and has a shift register circuit 1701, latch circuits 1702, switching circuits 1703, and pixels 1704. Reference numeral 1710 denotes a signal line into which a signal supplied from a gate signal line driver circuit, or directly from the outside, is input. The circuit structure of the pixel may be similar to that of embodiment 2, and therefore FIG. 6 may be referenced as is.

FIGS. 18A to 18C are timing charts relating to operation of the circuits shown in embodiment 3. An explanation is made using FIG. 6, FIG. 17, and FIGS. 18A to 18C.

A sampling pulse is output from the shift register circuit 1701, and operations up through the storage of a digital image signal by the latch circuit 1702 in accordance with the sampling pulse are similar to those of embodiment 1 and embodiment 2. The switching circuits 1703 are between the latch circuits 1702 and the volatile memory circuits within the pixels 1704 in embodiment 3, and therefore write-in to the volatile memory circuits does not begin immediately even after the digital image signals are stored by the latch circuits. A period until a dot data sampling period is complete is one in which the switching circuits 1703 remain closed. The digital image signal continues to be stored by the latch circuit during this period.

As shown in FIG. 18B, a latch signal (latch pulse) is input during a return period after storage of one horizontal period portion of the digital image signal is complete, and the switching circuits 1703 all open at once. The digital image signals stored by the latch circuits 1702 are written into the volatile memory circuits within the pixels 1704 all at once. Operations within the pixels 1704 concerning the write-in operations at this point, and in addition, operations within the pixels 1704 concerning the read-out operations at the time of the display occurring in the next frame period, are similar to those of embodiment 2, and therefore an explanation is omitted here. Similarly, a method of performing write-in to the non-volatile memory circuits, and related timing, may be in accordance with embodiment 2, and therefore those explanations are omitted here.

Line-sequential write-in drive can be easily performed with a source signal line driver circuit in which a latch circuit is omitted in accordance with the above method.

Embodiment 4

In Embodiment 4, a method of simultaneously manufacturing TFTs of a pixel portion of an electronic display device of the present invention and driver circuit portions provided in the periphery thereof (a source signal line driver circuit, a gate signal line driver circuit and a pixel selective signal line driver circuit). However, in order to simplify the explanation, a CMOS circuit, which is the basic circuit for the driver circuit, is shown in the figures.

First, as shown in FIG. 1A, abase film 5002 made of an insulating film such as a silicon oxide film, a silicon nitride film, or a silicon oxynitride film is formed on a substrate 5001 made of glass such as barium borosilicate glass or alumino borosilicate glass, typified by #7059 glass or #1737 glass of Corning Inc. For example, a silicon oxynitride film 5002*a* fabricated from $SiH_4$, $NH_3$ and $N_2O$ by a plasma CVD method is formed with a thickness of 10 to 200 nm (preferably 50 to 100 nm), and a hydrogenated silicon oxynitride film 5002*b* similarly fabricated from $SiH_4$ and $N_2O$ is formed with a thickness of 50 to 200 nm (preferably 100 to 150 nm) to form a lamination. In Embodiment 4, although the base film 5002 is shown as the two-layer structure, the film may be formed of a single layer film of the foregoing insulating film or as a lamination structure of more than two layers.

Island-like semiconductor films 5003 to 5007 are formed of a crystalline semiconductor film manufactured by using a laser crystallization method on a semiconductor film having an amorphous structure, or by using a known thermal crystallization method. The thickness of the island-like semiconductor films 5003 to 5007 is set from 25 to 80 nm (preferably between 30 and 60 nm). There is no limitation on the crystalline semiconductor film material, but it is preferable to form the film from silicon or a silicon germanium (SiGe) alloy.

A laser such as a pulse oscillation type or continuous emission type excimer laser, a YAG laser, or a $YVO_4$ laser is used for manufacturing the crystalline semiconductor film in the laser crystallization method. A method of condensing laser light emitted from a laser oscillator into a linear shape by an optical system and then irradiating the light to the semiconductor film may be employed when these types of lasers are used. The crystallization conditions may be suitably selected by the operator, but the pulse oscillation frequency is set to 30 Hz, and the laser energy density is set from 100 to 400 mJ/cm$^2$ (typically between 200 and 300 mJ/cm$^2$) when using the excimer laser. Further, the second harmonic is utilized when using the YAG laser, the pulse oscillation frequency is set from 1 to 10 kHz, and the laser energy density may be set from 300 to 600 mJ/cm$^2$ (typically between 350 and 500 mJ/cm$^2$). The laser light which has been condensed into a linear shape with a width of 100 to 1000 $\mu$m, for example 400 $\mu$m, is then irradiated over the entire surface of the substrate. This is performed with an overlap ratio of 80 to 98% in case of the linear laser.

Next, a first gate insulating film 5008 is formed covering the island-like semiconductor layers 5003 to 5007. The first gate insulating film 5008 is formed of an insulating film containing silicon with a thickness of 40 to 150 nm by plasma CVD method or a sputtering method. A 120 nm thick silicon oxynitride film is formed in Embodiment 4. The first gate insulating film 5008 is not limited to such a silicon oxynitride film, of course, and other insulating films containing silicon may also be used, in a single layer or in a lamination structure. For example, when using a silicon oxide film, it can be formed by the plasma CVD method with a mixture of TEOS (tetraethyl orthosilicate) and $O_2$, at a reaction pressure of 40 Pa, with the substrate temperature set from 300 to 400° C., and by discharging at a high frequency (13.56 MHz) with electric power density of 0.5 to 0.8 W/cm$^2$. Good characteristics of the silicon oxide film thus manufactured as a gate insulating film can be obtained by subsequently performing thermal annealing at 400 to 500° C.

A first conductive film 5009 and a second conductive film 5010 are then formed on the first gate insulating film 5008 in order to form gate electrodes. In Embodiment 4, the first conductive film 5009 is formed from Ta with a thickness of 50 to 100 nm, and the second conductive film 5010 is formed from W with a thickness of 100 to 300 nm.

The Ta film is formed by sputtering, and sputtering of a Ta target is performed by using Ar. If an appropriate amount of Xe or Kr is added to the Ar during sputtering, the internal stress of the Ta film will be relaxed, and film peeling can be prevented. The resistivity of a $\alpha$ phase Ta film is on the order of 20 $\mu\Omega$cm, and the Ta film can be used for the gate electrode, but the resistivity of a $\beta$ phase Ta film is on the order of 180 $\mu\Omega$cm and the Ta film is unsuitable for the gate electrode. The $\alpha$ phase Ta film can easily be obtained if a tantalum nitride film, which possesses a crystal structure near that of phase Ta, is formed with a thickness of 10 to 50 nm as a base for Ta in order to form the phase Ta film.

The W film is formed by sputtering with W as a target. The W film can also be formed by a thermal CVD method using tungsten hexafluoride ($WF_6$). Whichever is used, it is necessary to make the film low resistant in order to use it as the gate electrode, and it is preferable that the resistivity of the W film be set 20 $\mu\Omega$cm or less. The resistivity can be lowered by enlarging the crystals of the W film, but for cases where there are many impurity elements such as oxygen within the W film, crystallization is inhibited, and the film becomes high resistant. A W target having a purity of 99.9999% is thus used in sputtering. In addition, by forming the W film while taking sufficient care such that no impurities from the inside of the gas phase are introduced at the time of film formation, a resistivity of 9 to 20 $\mu\Omega$cm can be achieved.

Note that although the first conductive film 5009 and the second conductive film 5010 are formed from Ta and W, respectively, in Embodiment 4, the conductive films are not limited to these. Both the first conductive film 5009 and the second conductive film 5010 may also be formed from an element selected from the group consisting of Ta, W, Ti, Mo, Al, and Cu, or from an alloy material or a chemical compound material having one of these elements as its main constituent. Further, a semiconductor film, typically a polysilicon film, into which an impurity element such as phosphorus is doped, may also be used. Examples of preferable combinations other than that in Embodiment 4 include: the first conductive film 5009 formed from tantalum nitride (TaN) and the second conductive film 5010 formed from W; the first conductive film 5009 formed from tantalum nitride (TaN) and the second conductive film 5010 formed from Al; and the first conductive film 5009 formed from tantalum nitride (TaN) and the second conductive film 5010 formed from Cu.

Next, a mask 5011 is formed from resist, and a first etching process is performed in order to form electrodes and wirings. An ICP (inductively coupled plasma) etching method is used in Embodiment 4. A gas mixture of $CF_4$ and $Cl_2$ is used as an etching gas, and plasma is generated by applying a 500 W RF electric power (13.56 MHz) to a coil shape electrode at 1 Pa. A 100 W RF electric power (13.56 MHz) is also applied to the substrate side (test piece stage), effectively applying a negative self-bias voltage. The W film and the Ta film are both etched on the same order when $CF_4$ and $Cl_2$ are mixed.

Edge portions of the first conductive layer and the second conductive layer are made into a tapered shape in accordance with the effect of the bias voltage applied to the substrate side with the above etching conditions by using a suitable resist mask shape. The angle of the tapered portions is from 15 to 45°. The etching time may be increased by approximately 10 to 20% in order to perform etching without any residue on the gate insulating film. The selectivity of a silicon oxynitride film with respect to a W film is from 2 to 4 (typically 3), and therefore approximately 20 to 50 nm of the exposed surface of the silicon oxynitride film is etched by this over-etching process. First shape conductive layers 5012 to 5017 (first conductive layers 5012*a* to 5017*a* and second conductive layers 5012*b* to 5017*b*) are thus formed of the first conductive layer and the second conductive layer by the first etching process. At this point, regions of the first gate insulating film 5008 not covered by the first shape conductive layers 5012 to 5017 are made thinner by approximately 20 to 50 nm by etching. (FIG. 10B)

Then, a first doping process is performed to add an impurity element for imparting a n-type conductivity. Doping may be carried out by an ion doping method or an ion implanting method. The condition of the ion doping method is that a dosage is $1\times10^{13}$ to $5\times10^{14}$ atoms/cm$^2$, and an acceleration voltage is 60 to 100 keV. As the impurity element for imparting the n-type conductivity, an element belonging to group 15, typically phosphorus (P) or arsenic (As) is used, but phosphorus is used here. In this case, the conductive layers 5012, 5013 and 5015 to 5017 become masks to the impurity element to impart the n-type conductivity, and first impurity regions 5018 to 5022 are formed in a self-aligning manner. The impurity element to impart the n-type conductivity in the concentration range of $1\times10^{20}$ to $1\times10^{21}$ atoms/cm$^3$ is added to the first impurity regions 5018 to 5022. (FIG. 10B)

Next, as shown in FIG. 10C, a second etching process is performed without removing the mask formed from resist. The etching gas of the mixture of $CF_4$, $Cl_2$ and $O_2$ is used, and the W film is selectively etched. At this point, second shape conductive layers 5023 to 5028 (first conductive layers 5023*a* to 5028*a* and second conductive layers 5023*b* to 5028*b*) are formed by the second etching process. Regions of the first gate insulating film 5008, which are not covered with the second shape conductive layers 5023 to 5023 are made thinner by about 20 to 50 nm by etching.

An etching reaction of the W film or the Ta film by the mixture gas of $CF_4$ and $Cl_2$ can be guessed from a generated radical or ion species and the vapor pressure of a reaction product. When the vapor pressures of fluoride and chloride of W and Ta are compared with each other, the vapor pressure of $WF_6$ of fluoride of W is extremely high, and other $WCl_5$, $TaF_5$, and $TaCl_5$ have almost equal vapor pressures. Thus, in the mixture gas of $CF_4$ and $Cl_2$, both the W film and the Ta film are etched. However, when a suitable amount Of $O_2$ is added to this mixture gas, $CF_4$ and $O_2$ react with each other to form CO and F, and a large number of F radicals or F ions are generated. As a result, an etching rate of the W film having the high vapor pressure of fluoride is increased. On the other hand, with respect to Ta, even if F is increased, an increase of the etching rate is relatively small. Besides, since Ta is easily oxidized as compared with W, the surface of Ta is oxidized by addition of $O_2$. Since the oxide of Ta does not react with fluorine or chlorine, the etching rate of the Ta film is further decreased. Accordingly, it becomes possible to make a difference between the etching rates of the W film and the Ta film, and it becomes possible to make the etching rate of the W film higher than that of the Ta film.

Then, as shown in FIG. 11A, a second doping process is performed. In this case, a dosage is made lower than that of the first doping process and under the condition of a high acceleration voltage, an impurity element for imparting the n-type conductivity is doped. For example, the process is carried out with an acceleration voltage set to 70 to 120 keV and at a dosage of $1\times10^{13}$ atoms/cm$^2$, so that new impurity regions are formed inside of the first impurity regions formed into the island-like semiconductor layers in FIG. 10B. Doping is carried out such that the second shape conductive layers 5023 to 5028 are used as masks to the impurity element and the impurity element is added also to the regions under the first conductive layers 5026*a* to 5031*a*. In this way, third impurity regions 5023 to 5028 are formed. The concentration of phosphorus (P) added to the third impurity regions has a gentle concentration gradient in accordance with the thickness of tapered portions of the first conductive layers 5023*a* to 5028*a*. Note that in the semiconductor layer that overlap with the tapered portions of the first conductive layers 5023*a* to 5028*a*, the concentration of impurity element slightly falls from the end portions of the tapered portions of the first conductive layers 5023*a* to 5028*a* toward the inner portions, but the concentration keeps almost the same level.

As shown in FIG. 11B, a third etching process is performed. This is performed by using a reactive ion etching method (RIE method) with an etching gas of $CHF_6$. The tapered portions of the first conductive layers 5023*a* to 5028*a* are partially etched, and the region in which the first conductive layers overlap with the semiconductor layer is reduced by the third etching process. Third shape conductive layers 5034 to 5039 (first conductive layers 5034*a* to 5039*a* and second conductive layers 5034*b* to 5039*b*) are formed. At this point, regions of the first gate insulating film 5008, which are not covered with the third shape conductive layers 5034 to 5039 are made thinner by about 20 to 50 nm by etching.

By the third etching process, in third impurity regions 5029 to 5033, third impurity regions 5029*a* to 5033*a*, which overlap with the first conductive layers 5034*a* to 5039*a*, and second impurity regions 5029*b* to 5033*b* between the first impurity regions and the third impurity regions are formed.

Then, as shown in FIG. 11C, fourth impurity region 5041 having a conductivity type opposite to the first conductivity type are formed in the island-like semiconductor layer 5004 for forming P-channel TFTS. The third conductive layer 5038*b* is used as masks to an impurity element, and the impurity regions are formed in a self-aligning manner. At this time, the whole surfaces of the island-like semiconductor layers 5003, 5005, 5006 and 5007 and the wiring portion 5036, which form N-channel TFTs are covered with a resist mask 5040. Phosphorus is added to the impurity region 5041 different concentrations, respectively. The regions are formed by an ion doping method using diborane ($B_2H_6$) and the impurity concentration is made $2\times10^{20}$ to $2\times10^{21}$ atoms/cm$^3$ in any of the regions.

By the steps up to this, the impurity regions are formed in the respective island-like semiconductor layers. The third shape conductive layers 5034, 5035, 5037 and 5039 overlapping with the island-like semiconductor layers function as gate electrodes. The third shaped conductive layer 5038 overlapping with the island-like semiconductor layer functions as a floating gate of a memory TFT in the nonvolatile memory circuit. The conductive layer 5036 functions as an island-like source signal line.

After the resist mask 5040 is removed, a step of activating the impurity elements added in the respective island-like semiconductor layers for the purpose of controlling the conductivity type. This step is carried out by a thermal annealing method using a furnace annealing oven. In addition, a laser annealing method or a rapid thermal annealing method (RTA method) can be applied. The thermal annealing method is performed in a nitrogen atmosphere having an oxygen concentration of 1 ppm or less, preferably 0.1 ppm or less and at 400 to 700° C., typically 500 to 600° C. In Embodiment 4, a heat treatment is conducted at 500° C. for 4 hours. However, in the case where a wiring material used for the third conductive layers 5034 to 5039 is weak to heat, it is preferable that the activation is performed after an interlayer insulating film (containing silicon as its main ingredient) is formed to protect the wiring line or the like.

Further, a heat treatment at 300 to 450° C. for 1 to 12 hours is conducted in an atmosphere containing hydrogen of 3 to 100%, and a step of hydrogenating the island-like semiconductor layers is conducted. This step is a step of terminating dangling bonds in the semiconductor layer by thermally excited hydrogen. As another means for hydrogenation, plasma hydrogenation (using hydrogen excited by plasma) may be carried out.

Figures 12A, 12B:
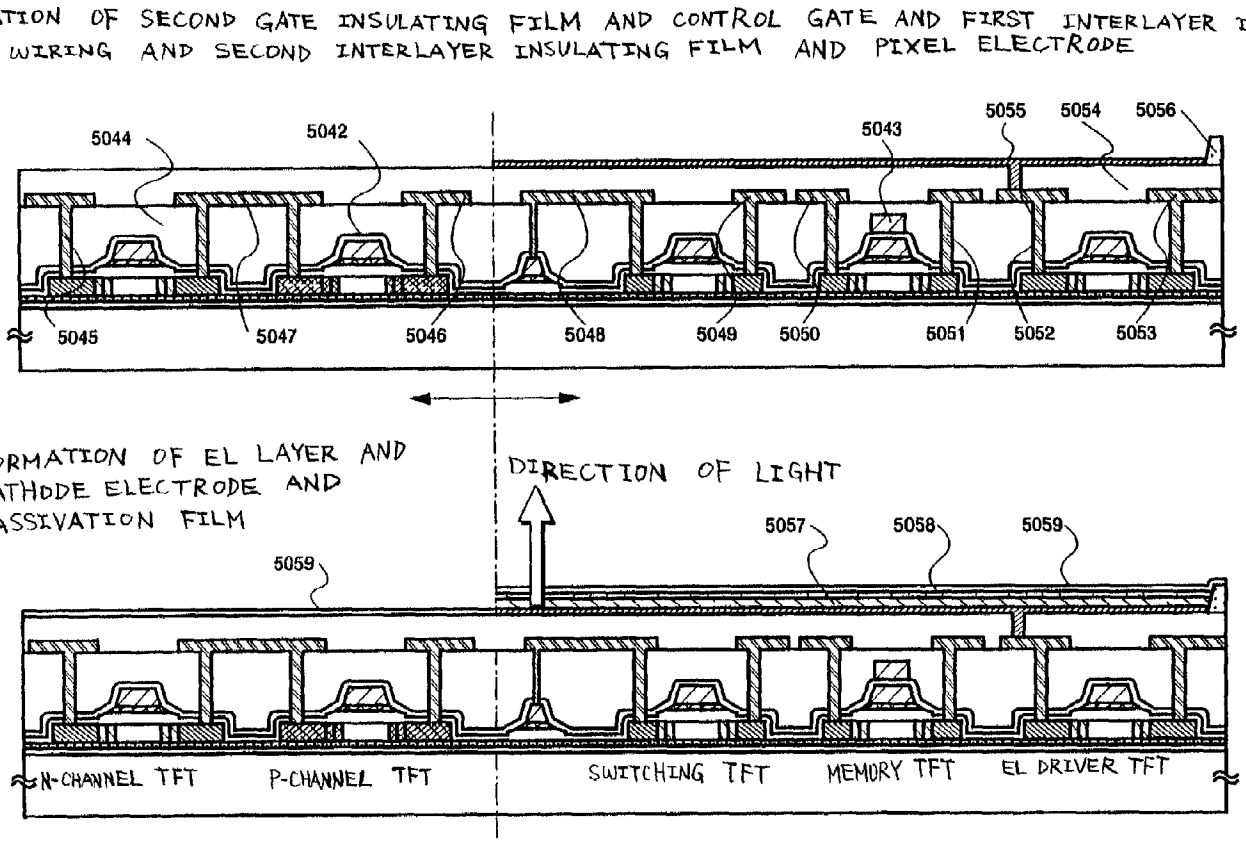
FIGS. 12A and 12B are diagrams showing the example of the method of manufacturing an electronic device having a pixel of the present invention.
Figure 13:
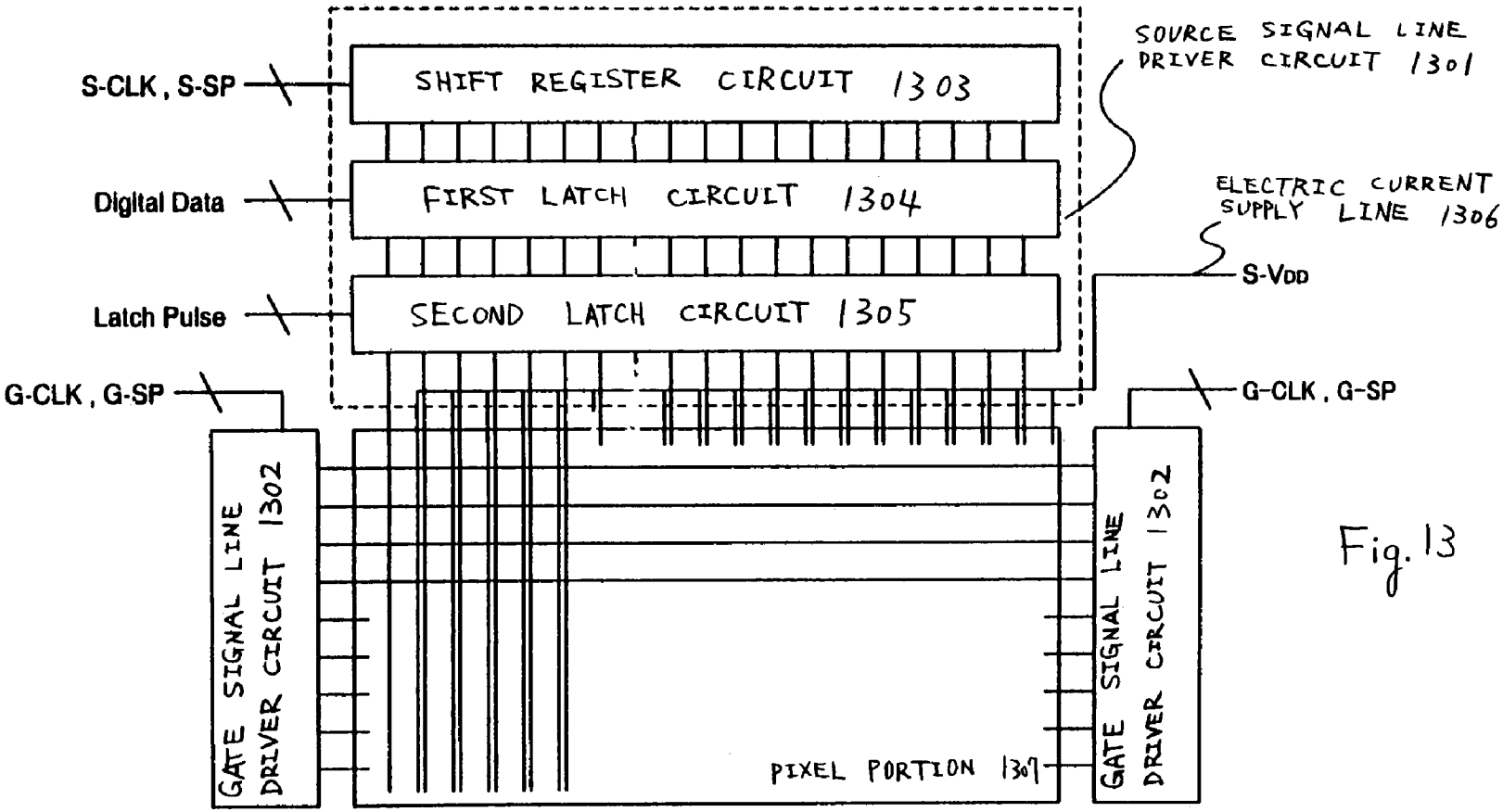
Fig. 13 PRIOR ART
FIG. 13 is a diagram showing a schematic of an entire circuit structure of a conventional electronic device.
Figure 14:
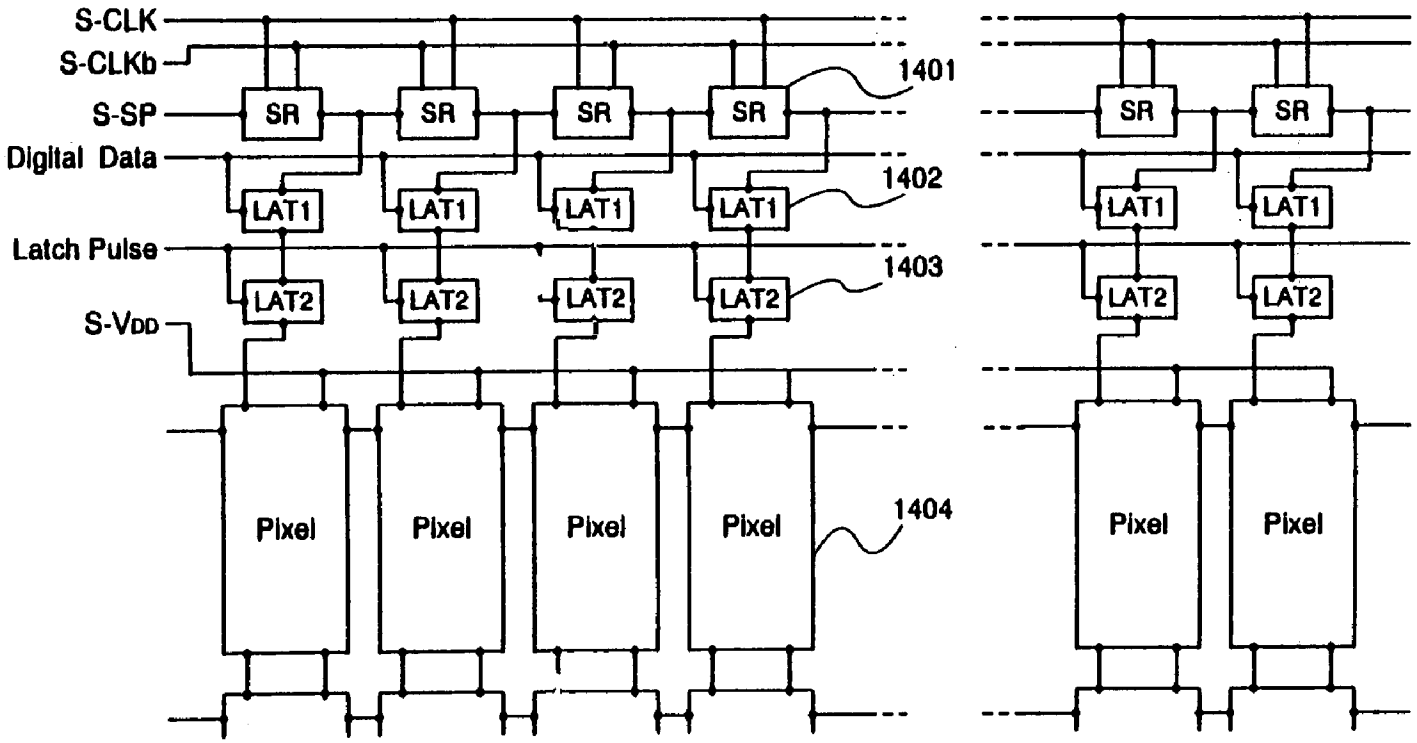
FIG. 14 is a diagram showing an example of a circuit structure of a source signal line driver circuit of a conventional electronic device.

Next, as shown in FIG. 12A, a second gate insulating film 5042 is formed. After forming a third conductive film, the control gate 5043 of a memory TFT is formed by a patterning.

The first interlayer insulating film 5056 from an organic insulating material is formed. Contact holes are then formed and respective wirings (including connection wirings and signal lines) 5045 to 5053 are formed by patterning.

Subsequently, the second interlayer insulating film 5054 and the contact holes are formed at the drain wiring 5052 of the EL driver TFT, and thus the pixel electrode 5063 is formed by patterning. And at this stage, the bank 5056 is formed.

Next, the film made from organic resin is used for the second interlayer insulating film 5054. As the organic resin, polyimide, polyamide, acryl, BCB (benzocyclobutene) or the like can be used. Especially, since the second interlayer insulating film 5054 has rather the meaning of flattening, acryl is desirable in flatness. In Embodiment 4, an acryl film is formed to such a thickness that stepped portions formed by the TFTs can be adequately flattened.

In the formation of the contact holes, dry etching or wet etching is used, and contact holes reaching the n-type impurity regions or the p-type impurity regions, a contact hole reaching the wiring, a contact hole reaching the power source supply line (not shown), and contact holes reaching the gate electrodes (not shown) are formed, respectively.

Further, a lamination film of a three layer structure, in which a 100 nm thick Ti film, a 300 nm thick aluminum film containing Ti, and a 150 nm thick Ti film are formed in succession by sputtering, is patterned into a desirable shape, and the resultant lamination film is used as the wirings (including connection wirings and signal lines) 5045 to 5053. Of course, other conductive films may be used.

Furthermore, in Embodiment 4, an MgAg film is formed with a thickness of 110 nm, and patterning is performed to form the pixel electrode 5055. (FIG. 12A)

An EL layer 5057 and a transparent electrode 5058 are formed next in succession, without exposure to the atmosphere, using a vacuum evaporation method. Note that the film thickness of the EL layer 5057 may be set from 80 to 200 nm (typically between 100 and 120 nm), and the thickness of the transparent electrode 5058 is formed from ITO film.

A known material can be used as the EL layer 5057. Considering the driver voltage, it is preferable to use an organic material as the known material. For example, a four layer structure constituted of a hole injecting layer, a hole transporting layer, a light emitting layer and an electron injecting layer may be adopted as an EL layer.

Finally, a passivation film 5059 made of a silicon nitride film is formed with a thickness of 300 nm. The formation of the passivation film 5059 enables the EL layer 5057 to be protected against moisture and the like, and the reliability of the EL element can further be enhanced.

Consequently, the EL display panel with the structure as shown in FIG. 12B is completed. Note that, in the manufacturing process of the EL display in Embodiment 4, the source signal lines are formed from Ta and W, which are materials for forming gate electrodes, and the gate signal lines are formed from A1, which is a material for forming wirings, but different materials may be used.

TFT in the active matrix type electronic device formed by the above mentioned steps has a top gate structure, but this embodiment can be easily applied to bottom gate structure TFT and other structure TFT.

Further, the glass substrate is used in this embodiment, but it is not limited. Other than glass substrate, such as the plastic substrate, the stainless substrate and the single crystalline wafers can be used to implement.

Incidentally, the EL display panel in Embodiment 4 exhibits the very high reliability and has the improved operational characteristic by providing TFTs having the most suitable structure in not only the pixel portion but also the driver circuit portion. Further, it is also possible to add a metallic catalyst such as Ni in the crystallization process, thereby increasing crystallinity. It therefore becomes possible to set the driving frequency of the source signal line driver circuit to 10 MHz or higher.

First, a TFT having a structure in which hot carrier injection is reduced without decreasing the operating speed as much as possible is used as an N-channel TFT of a CMOS circuit forming the driver circuit portion. Note that the driver circuit referred to here includes circuits such as a shift register, a buffer, a level shifter, a latch in line-sequential drive, and a transmission gate in dot-sequential drive.

In Embodiment 4, the active layer of the N-channel TFT contains the source region, the drain region, the LDD region overlapping with the gate electrode with the gate insulating film sandwiched therebetween (Lov region), the LDD region not overlapping with the gate electrode with the gate insulating film sandwiched therebetween (Loff region), and the channel forming region.

Further, there is not much need to worry about degradation due to the hot carrier injection with the P-channel TFT of the CMOS circuit, and therefore LDD regions may not be formed in particular. It is of course possible to form LDD regions similar to those of the N-channel TFT, as a measure against hot carriers.

In addition, when using a CMOS circuit in which electric current flows in both directions in the channel forming region, namely a CMOS circuit in which the roles of the source region and the drain region interchange, it is preferable that LDD regions be formed on both sides of the channel forming region of the N-channel TFT forming the CMOS circuit, sandwiching the channel forming region. A circuit such as a transmission gate used in dot-sequential drive can be given as an example of such. Further, when a CMOS circuit in which it is necessary to suppress the value of the off current as much as possible is used, the N-channel TFT forming the CMOS circuit preferably has a Lov region. A circuit such as the transmission gate used in dot-sequential drive can be given as an example of such.

Note that, in practice, it is preferable to perform packaging (sealing), without exposure to the atmosphere, using a protecting film (such as a laminated film or an ultraviolet cured resin film) having good airtight properties and little out gassing, or a transparent sealing material, after completing through the state of FIG. 12B. At this time, the reliability of the EL element is increased by making an inert atmosphere on the inside of the sealing material and by arranging a drying agent (barium oxide, for example) inside the sealing material.

Further, after the airtight properties have been increased by the packaging process, a connector (flexible printed circuit: FPC) is attached in order to connect terminals led from the elements or circuits formed on the substrate with external signal terminals. Then, a finished product is completed. This state at which the product is ready for shipment is referred to as an electronic device throughout this specification.

Furthermore, in accordance with the process shown in Embodiment 4, the number of photo masks required for manufacture of an electronic device can be suppressed. As a result, the process can be shortened, and the reduction of the manufacturing cost and the improvement of the yield can be attained.

In the case of an EL element having the structure described in Embodiment 4, light generated in the EL layer 5057 is radiated to reverse direction to the substrate on which TFTs are formed as indicated by an arrow. Therefore if the number of elements which is structuring the pixel portion is increased, it is efficient to apply the active matrix type display device the present invention, because there is no need to worry about a reduction of aperture ratio. The pixel electrode 5055 or transparent electrode 5058 can be used reverse to make the light generated in the EL layer 5057 radiate to reverse direction to this embodiment. Thus, the transparent electrode is used as the pixel electrode 5055 and the MgAg electrode is used as the cathode electrode 5058.

Embodiment 5

In the pixel portions of the electronic devices of the present invention shown in embodiments 1 to 3, structures are shown in which static memories (static RAM, SRAM) are used as the volatile memory circuits, but the volatile memory circuits are not limited to only SRAMs. Memory such as dynamic memory (dynamic RAM, DRAM) can be given as an example of another type of memory which can be applied to the volatile memory circuits in the pixel portion of the electronic devices of the present invention. In embodiment 5, examples of structures of circuits using these types of volatile memory are introduced.

Figure 8:
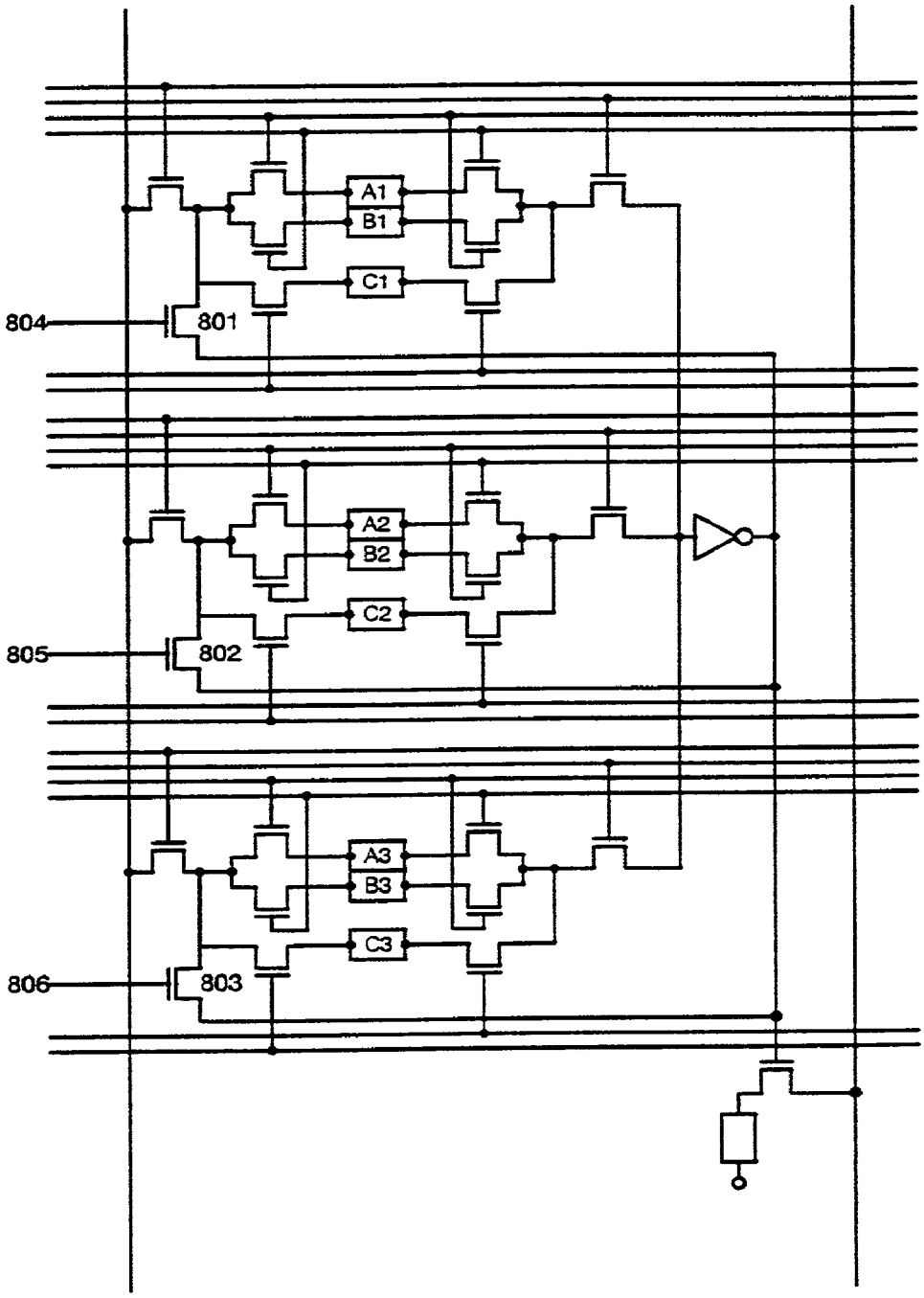
FIG. 8 is a detailed circuit diagram of a pixel of the present invention for a case of using a dynamic memory in a volatile memory circuit.
Figures 9A, 9B, 9C, 9D:
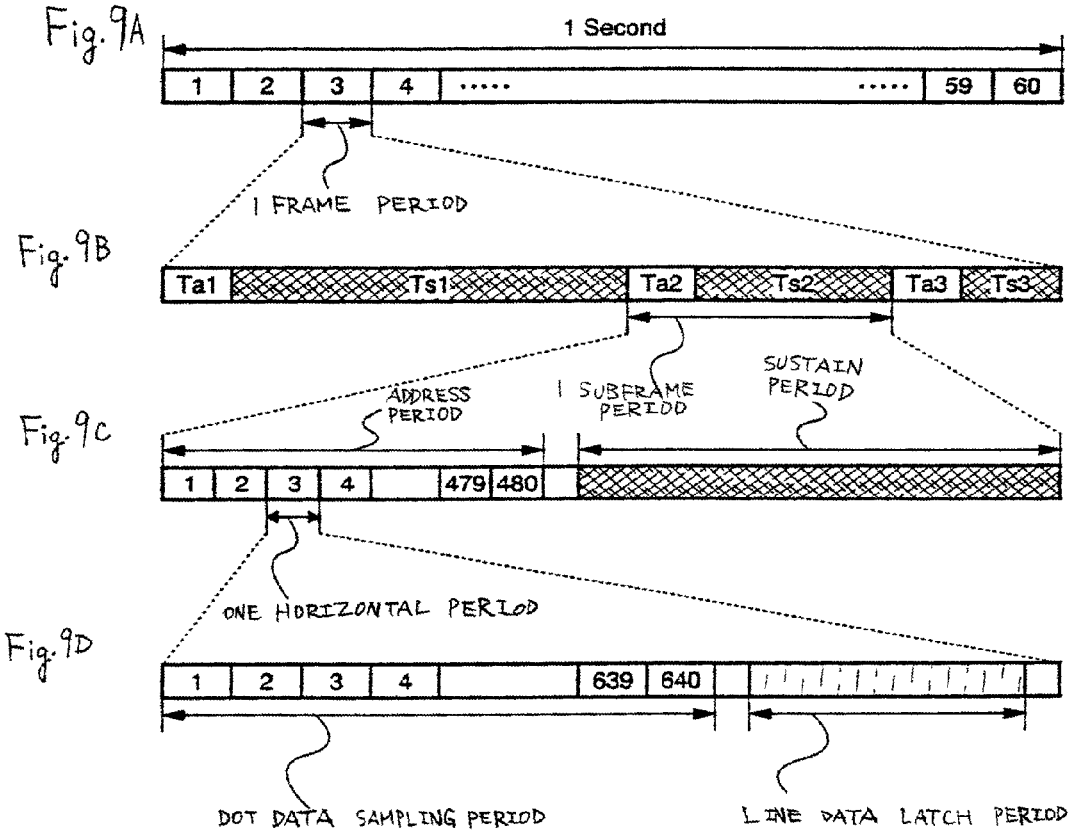
FIGS. 9A to 9D are diagrams showing timing charts of a general example of a time gray scale method in an electronic device.

FIG. 8A shows an example of using DRAM in the volatile memory circuits A1 to A3, and B1 to B3, arranged in a pixel. Basic structures are similar to the circuits shown by embodiment 1. A general structure DRAM may be used for the DRAM used in the volatile memory circuits A1 to A3, and B1 to B3. A relatively simple structure is shown in the figures in embodiment 5, structured by an inverter and a capacitor as shown in FIG. 8B.

Operation of a source signal line driver circuit is similar to that of embodiment 1. Periodic rewrite operations (hereafter referred to as refresh) are necessary for DRAM here, differing from the case of SRAM, and therefore the circuits have refresh TFTs 801 to 803. The refresh TFTs 801 to 803 are made conductive at a certain timing in a period for display of a static image (a period during which display is performed by repeatedly reading out a digital image signal stored in the volatile memory circuits), and refresh is performed by feeding back an electric charge in the pixel portion to the volatile memory circuit side.

In addition, although not shown in the figures in particular, it is also possible to structure the pixel portion of the electronic devices of the present invention by utilizing ferroelectric RAM (FeRAM) as another type of volatile memory circuit. FeRAM is a non-volatile memory having a write-in speed equivalent to that of SRAM and DRAM, and by utilizing its characteristics such as a low write-in voltage, it is possible to additionally reduce the power consumption of the electronic devices of the present invention. Further, it is also possible to structure the volatile memory circuits using memories such as flash memories.

Embodiment 6

An active matrix type display device using a driver circuit which is formed along with the present invention has various usages. In this embodiment, the semiconductor device implemented the display device using a driver circuit which is formed along with the present invention.

The following can be given as examples of such display devices: a portable information terminal (such as an electronic book, a mobile computer, or a mobile telephone), a video camera; a digital camera; a personal computer and a television. Examples of those equipments are shown in FIGS. 15 and 16.

Figure 15A:
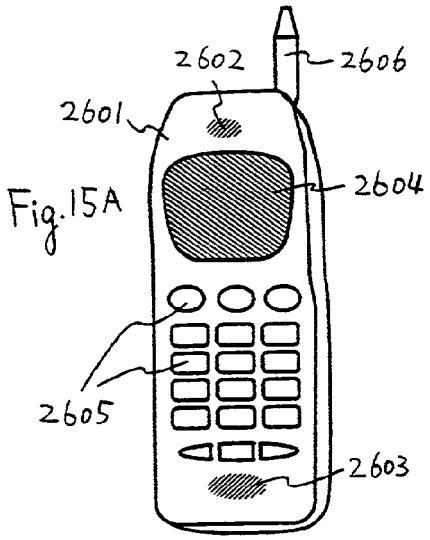
FIGS. 15A to 15F are diagrams showing examples of electronic equipment capable of applying a display device having a pixel of the present invention.

FIG. 15A is a portable telephone which includes a main body 2601, a voice output portion 2602, a voice input portion 2603, a display portion 2604, operation switches 2605, and an antenna 2606. The present invention can be applied to the display portion 2604.

Figure 15B:
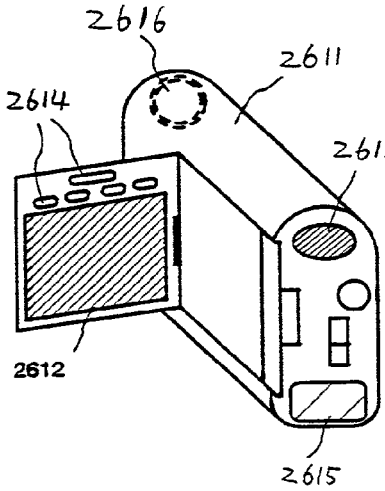

FIG. 15B illustrates a video camera which includes a main body 2611, a display portion 2612, an audio input portion 2613, operation switches 2614, a battery 2615, an image receiving portion 2616, or the like. The present invention can be applied to the display portion 2612.

Figure 15C:
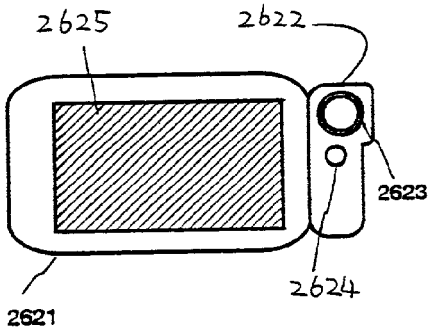

FIG. 15C illustrates a mobile computer or portable information terminal which includes a main body 2621, a camera section 2622, an image receiving section 2623, operation switches 2624, a display portion 2625, or the like. The present invention can be applied to the display portion 2625.

Figure 15D:
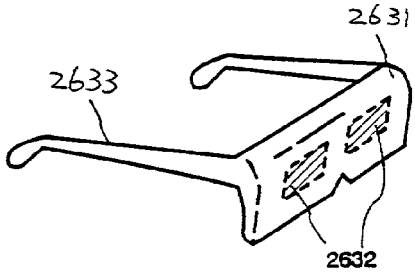

FIG. 15D illustrates a head mounted display which includes a main body 2631, a display portion 2632 and an arm portion 2633. The present invention can be applied to the display portion 2632.

Figure 15E:
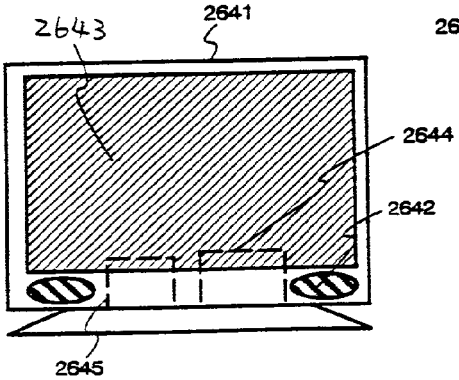

FIG. 15E illustrates a television which includes a main body 2641, a speaker 2642, a display portion 2643, an input device 2644 and an amplifier device 2645. The present invention can be applied to the display portion 2643.

Figure 15F:
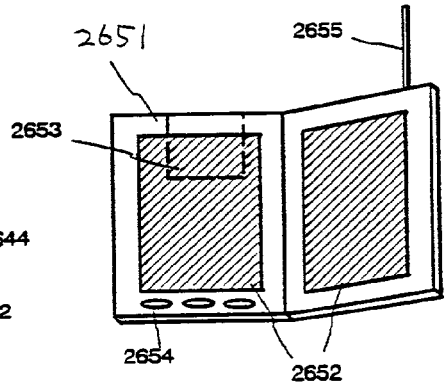

FIG. 15F illustrates a portable electronic book which includes a main body 2651, display portion 2652, a memory medium 2653, an operation switch 2654 and an antenna 2655 and the portable electronic displays a data recorded in mini disc (MD) and DVD (Digital Versatile Disc) and a data recorded by an antenna. The present invention can be applied to the display portions 2652.

Figure 16A:
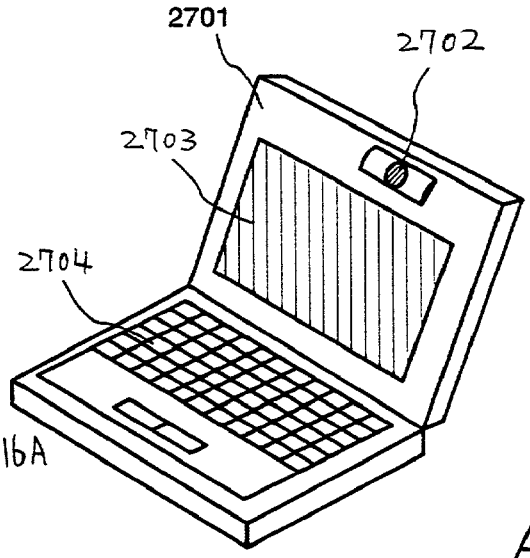
FIGS. 16A to 16D are diagrams showing examples of electronic equipment capable of applying a display device having a pixel of the present invention.

FIG. 16A illustrates a personal computer which includes a main body 2701, an image input portion 2702, a display portion 2703, a key board 2704, or the like. The present invention can be applied to the display portion 2703.

Figure 16B:
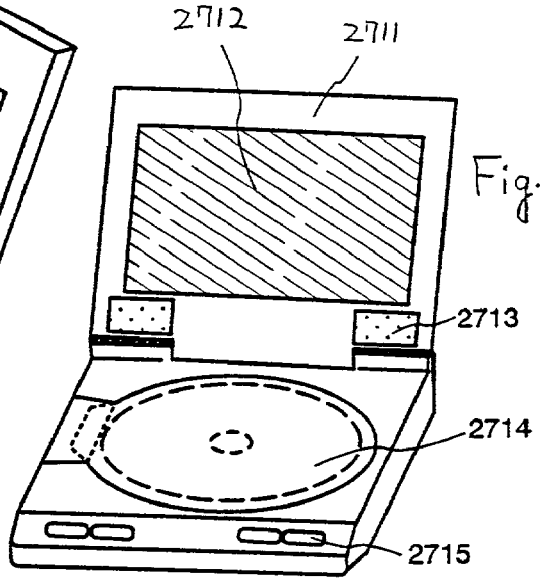

FIG. 16B illustrates a player using a recording medium which records a program and includes a main body 2711, a display portion 2712, a speaker section 2713, a recording medium 2714, and operation switches 2715. This player uses DVD (digital versatile disc), CD, etc. for the recording medium, and can be used for music appreciation, film appreciation, games and Internet. The present invention can be applied to the display portion 2712.

Figure 16C:
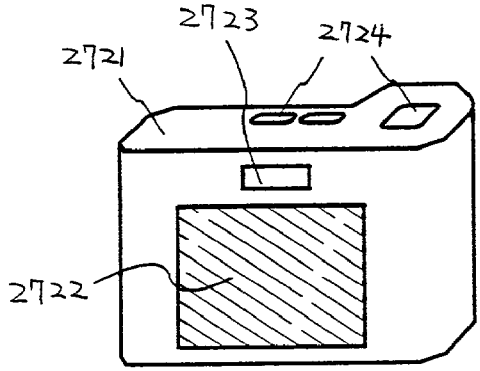

FIG. 16C illustrates a digital camera which includes a main body 2721, a display portion 2722, a view finder portion 2723, operation switches 2724, and an image receiving section (not shown in the figure). The present invention can be applied to the display portion 2722.

Figure 16D:
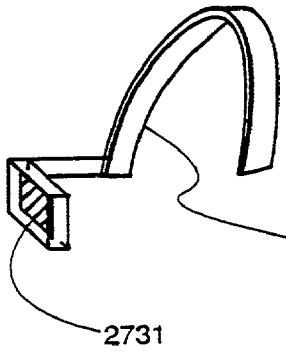

FIG. 16D illustrates a one-eyed head mounted display which includes a main body 2731 and band portion 2732. The present invention can be applied to the display portion 2731.

Embodiment 7

Figure 21:
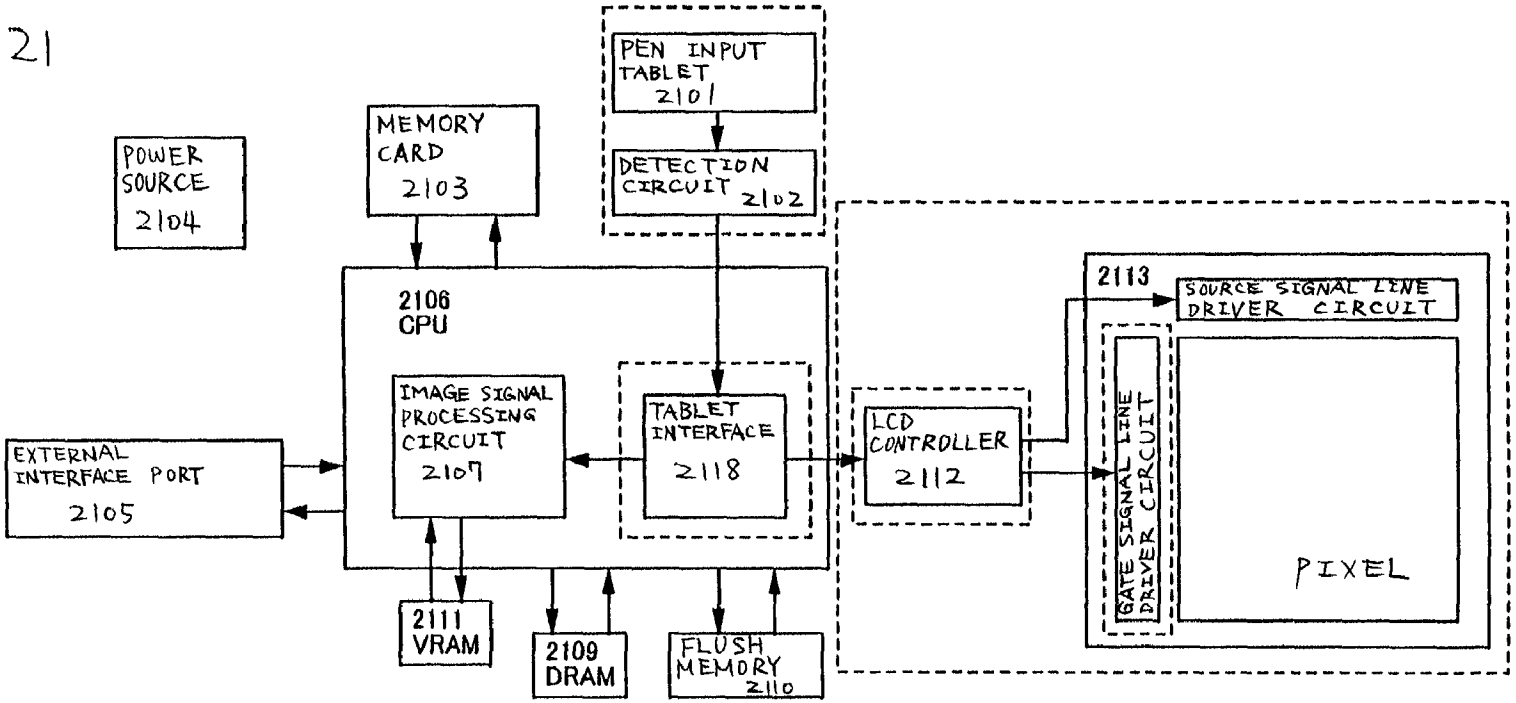
FIG. 21 is a block diagram of a portable information terminal employing the present invention.

An example of implementing the present invention in a portable information terminal is shown in FIG. 21. For a case of displaying a static image in this example, the functions of circuits such as an image signal processing circuit 2107, and a VRAM 2111 are stopped, and the electric power consumption can be reduced. Portions which perform operations are shown by dotted lines in FIG. 21. Further, a controller 2112 may be mounted in a display device 2113, and may also be formed as integrated on the inside of the display device.

Figure 22:
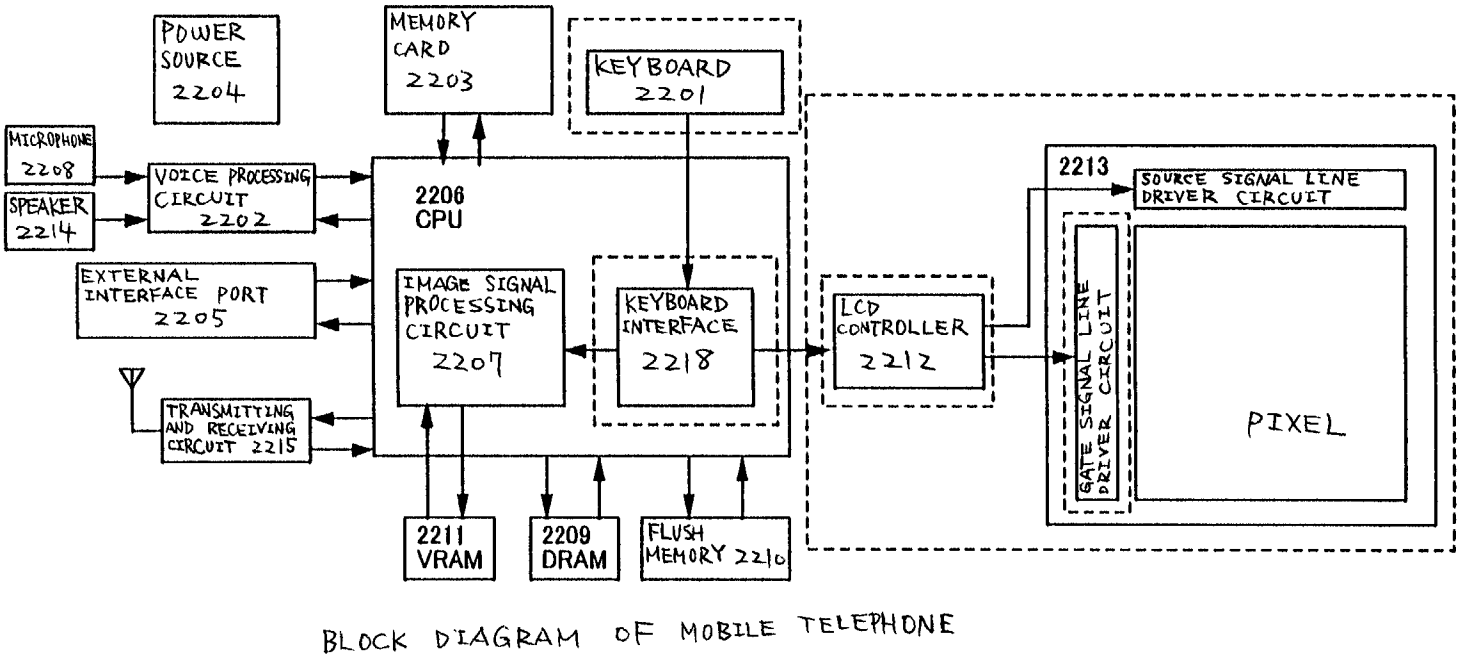
FIG. 22 is a block diagram of a portable telephone employing the present invention.
Figure 23:
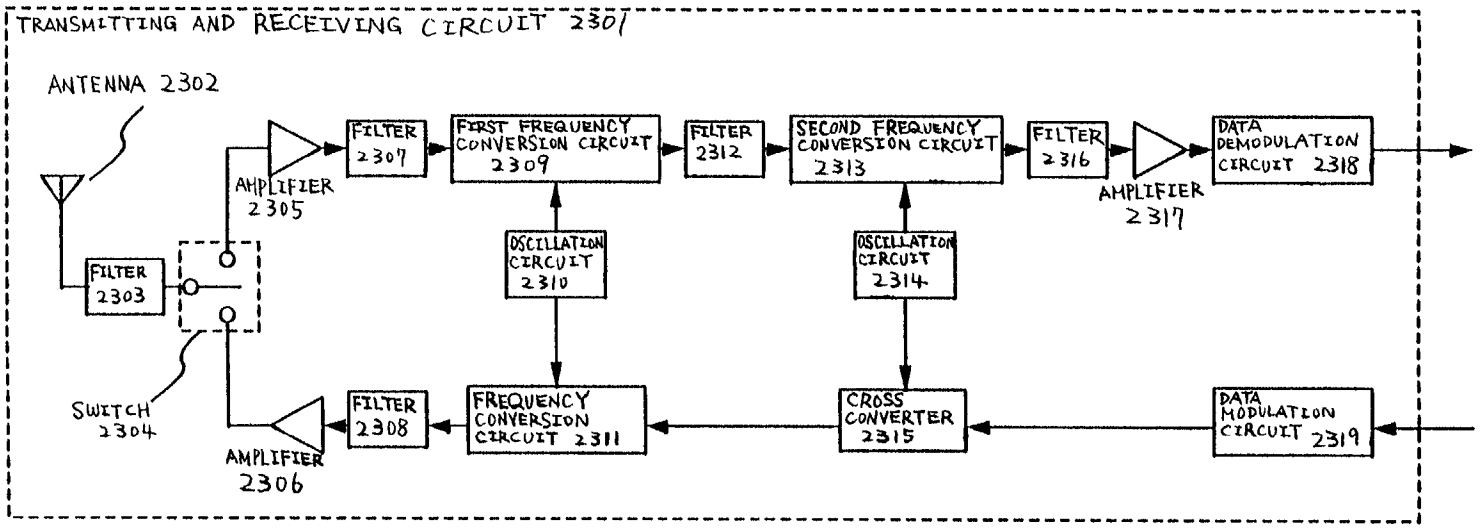
FIG. 23 is a block diagram of a signal transmitter-receiver portion of a portable telephone.

FIGS. 22 and 23 show examples of implementing the present invention in a portable telephone. Similar to FIG. 21, a portion of the functions can be stopped for display of a static image, and therefore the electric power consumption can be reduced.

It becomes possible to stop a source signal line driver circuit when performing continuous static image display by repeatedly using a digital image signal stored in volatile memory circuits in each frame period when displaying the static image in accordance with performing digital image signal storage using a plurality of volatile memory circuits arranged on the inside of each pixel. In addition, it becomes possible to store the digital image signal after an electric power source is cutoff by storing the digital image signal using non-volatile memory circuits arranged in each pixel, and this contributes greatly to reducing the power consumption of the entire electronic device.

What is claimed is:

1. An electronic device comprising a plurality of pixels, each of the pixels having:

a source signal line;

n (where n is a natural number, n≧2) gate signal lines used for write-in;

n gate signal lines used for read-out;

n transistors used for write-in;

n transistors used for read-out;

n×m volatile memory circuits for storing m frame portions (where m is a natural number, m≧1) of an n-bit digital image signal;

n×k non-volatile memory circuits for storing k frame portions (where k is a natural number, k≧1) of the n-bit digital image signal;

2n volatile memory circuit selection portions;

2n non-volatile memory circuit selection portions;

an electric current supply line;

an EL driver transistor; and an EL element;

wherein:

gate electrodes of the n write-in transistors are each electrically connected to any one of the n write-in gate signal lines, with each of said gate electrodes connected to a different write-in gate signal line;

input electrodes of the n write-in transistors are each electrically connected to the source signal line;

output electrodes of the n write-in transistors are each electrically connected to the volatile memory circuits through any one of the volatile memory circuit selection portions, with each of said output electrodes being connected through a different volatile memory circuit selection portion;

the output electrodes of the n write-in transistors are each electrically connected to the non-volatile memory circuits through any one of the non-volatile memory circuit selection portions, with each of said output electrodes being connected through a different non-volatile memory circuit selection portion;

gate electrodes of the n read-out transistors are each electrically connected to any one of the n read-out gate signal lines, with each of said gate electrodes connected to a different read-out gate signal line;

the input electrodes of the n read-out transistors are each electrically connected to the volatile memory circuits through any one of the volatile memory circuit selection portions, with each of said input electrodes being connected through a different volatile memory circuit selection portion;

the input electrodes of the n read-out transistors are each electrically connected to the non-volatile memory circuits through any one of the non-volatile memory circuit selection portions, with each of said input electrodes being connected through a different non-volatile memory circuit selection portion;

the output electrodes of the n read-out transistors are each electrically connected to a gate electrode of the EL driver transistor;

an input electrode of the EL driver transistor is electrically connected to the electric current supply line; and an output electrode of the EL driver transistor is electrically connected to one electrode of the EL element.

2. A device according to claim 1, wherein the volatile memory circuits are static memories (SRAMs).

3. A device according to claim 1, wherein the volatile memory circuits are ferroelectric memories (FeRAMs).

4. A device according to claim 1, wherein the volatile memory circuits are dynamic memories (DRAMs).

5. A device according to claim 1, wherein the non-volatile memory circuits are electrically writable, readable, and erasable non-volatile memories (EEPROMs).

6. A device according to claim 1, wherein the volatile and non-volatile memory circuits are formed over a glass substrate.

7. A device according to claim 1, wherein the volatile and non-volatile memory circuits are formed over a plastic substrate.

8. A device according to claim 1, wherein the volatile and non-volatile memory circuits are formed over a stainless steel substrate.

9. A device according to claim 1, wherein the volatile and non-volatile memory circuits are formed on a single crystal wafer.

10. Electronic equipment employing the electronic device according to claim 1.

11. Electronic equipment according to claim 10, wherein the electronic equipment is at least one selected from the group consisting of: a television, a personal computer, a portable terminal, a video camera, and a head mounted display.

12. A device according to claim 1, wherein:

the volatile memory circuit selection portions:

select any one circuit from among the volatile memory circuits and the non-volatile memory circuits, make the output electrode of the write-in transistor conductive to the selected one circuit from among the volatile memory circuits and the non-volatile memory circuits, and perform write-in of the digital image signal to the selected one circuit; or select any one circuit from among the volatile memory circuits and the non-volatile memory circuits, make the input electrode of the write-in transistor conductive to the selected one circuit from among the volatile memory circuits and the non-volatile memory circuits, and perform read-out of the digital image signal from the selected one circuit.

13. A device according to claim 1, wherein the electronic device has:

a shift register for outputting sampling pulses one after another in accordance with a clock signal and a start pulse;

a first latch circuit for storing the n-bit digital image signal (where n is a natural number, n≧2) in accordance with the sampling pulse;

a second latch circuit into which the n-bit digital image signal stored in the first latch circuit is transferred; and a bit selection circuit for selecting, in order, single bits of the n-bit digital image signal transferred to the second latch circuit, and outputting the selected single bits to the source signal line.

14. An electronic device comprising a plurality of pixels, each of the pixels having:

n (where n is a natural number n≧2) source signal lines;
n gate signal lines used for write-in;
n gate signal lines used for read-out;
n transistors used for write-in;
n transistors used for read-out;
n×m volatile memory circuits for storing m frame portions (where m is a natural number, m≧1) of an n-bit digital image signal;
n×k non-volatile memory circuits for storing k frame portions (where k is a natural number, k≧1) of the n-bit digital image signal;
2n volatile memory circuit selection portions;
2n non-volatile memory circuit selection portions;
an electric current supply line;
an EL driver transistor; and
an EL element;

wherein:

gate electrodes of the n write-in transistors are each electrically connected to any one of the write-in gate signal lines, with each of said gate electrodes being connected to a different write-in gate signal line;

input electrodes of the n write-in transistors are each electrically connected to any one of the sources signal lines, with each of said input electrodes being connected to a different source signal line;

output electrodes of the n write-in transistors are electrically connected to volatile memory circuits through any one of the volatile memory circuit selection portions, with each of said output electrodes being connected through a different volatile memory circuit selection portion;

the output electrodes of the n write-in transistors are electrically connected to the non-volatile memory circuits through any one of the non-volatile memory circuit selection portions, with each of said output electrodes being connected through a different non-volatile memory circuit selection portion;

gate electrodes of the n read-out transistors are each electrically connected to any one of the n read-out gate signal lines, with each of said gate electrodes being connected to a different read-out gate signal line;

input electrodes of the n read-out transistors are electrically connected to the non-volatile memory circuits through any one of the volatile memory circuit selection portions, with each of said input electrodes being connected through a different volatile memory circuit selection portion;

the input electrodes of the n read-out transistors are electrically connected to the non-volatile memory circuits through any one of the non-volatile memory circuit selection portions, with each of said input electrodes being connected through a different non-volatile selection portion;

the output electrodes of the n in read-out transistors are each electrically connected to a gate electrode of the EL driver transistor;

an input electrode of the EL driver transistor is electrically connected to the electric current supply line; and an output electrode of the EL driver transistor is electrically connected to one electrode of the EL element.

15. A device according to claim 14, wherein the volatile memory circuits are static memories (SRAMs).

16. A device according to claim 14, wherein the volatile memory circuits are ferroelectric memories (FeRAMs).

17. A device according to claim 14, wherein the volatile memory circuits are dynamic memories (DRAMs).

18. A device according to claim 14, wherein the non-volatile memory circuits are electrically writable, readable, and erasable non-volatile memories (EEPROMs).

19. A device according to claim 14, wherein the volatile and non-volatile memory circuits are formed over a glass substrate.

20. A device according to claim 14, wherein the volatile and non-volatile memory circuits are formed over a plastic substrate.

21. A device according to claim 14, wherein the volatile and non-volatile memory circuits are formed over a stainless steel substrate.

22. A device according to claim 14, wherein the volatile and non-volatile memory circuits are formed on a single crystal wafer.

23. A device according to claim 14, wherein:

the memory circuit selection portions:

select any one circuit from among the volatile memory circuits and the non-volatile memory circuits, make the output electrode of the write-in transistor conductive to the selected one circuit from among the volatile memory circuits and the non-volatile memory circuits, and perform write-in of the digital image signal to the selected one circuit; or select any one circuit from among the volatile memory circuits and the non-volatile memory circuits, make the input electrode of the write-in transistor conductive to the selected one circuit from among the volatile memory circuits and the non-volatile memory circuits, and perform read-out of the digital image signal from the selected one circuit.

24. A device according to claim 14, wherein the electronic device has:

a shift register for outputting sampling pulses one after another in accordance with a clock signal and a start pulse:

a first latch circuit for storing one bit of the digital image signal from among the n-bit digital image signal (where n is a natural number n≧2); and a second latch circuit into which the one bit of the digital image signal stored in the first latch circuit is transferred, and which outputs the one bit of the digital image signal to the source signal line.

25. A device according to claim 14, wherein the electronic device has:

a shift register for outputting sampling pulses one after another in accordance with a clock signal and a start pulse:

a latch circuit for storing one bit of the digital image signal in accordance with the sampling pulse: and a bit selection circuit for selecting the source signal line for outputting the one bit of the digital image signal which has been transferred to the latch circuit.

26. Electronic equipment employing the electronic device according to claim 14.

27. Electronic equipment according to claim 26, wherein the electronic equipment is at least one selected from the group consisting of: a television, a personal computer, a portable terminal, a video camera, and a head mounted display.

* * * * *